US010894704B2

(12) United States Patent
Leibinger

(10) Patent No.: US 10,894,704 B2
(45) Date of Patent: Jan. 19, 2021

(54) METHOD FOR FILLING CYLINDRICAL CONTAINERS, IN PARTICULAR CANS, AND FILLING ARRANGEMENT OF A FILLING DEVICE AND A CONTAINER

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 0 days.

(21) Appl. No.: 16/468,065

(22) PCT Filed: Dec. 20, 2017

(86) PCT No.: PCT/EP2017/001433
§ 371 (c)(1),
(2) Date: Jun. 10, 2019

(87) PCT Pub. No.: WO2018/127268
PCT Pub. Date: Jul. 12, 2018

(65) Prior Publication Data

US 2020/0017343 A1 Jan. 16, 2020

(30) Foreign Application Priority Data

Jan. 5, 2017 (EP) ..... 17000013

(51) Int. Cl.
*B67C 3/26* (2006.01)
*B65B 3/06* (2006.01)
(Continued)

(52) U.S. Cl.
CPC ..... *B67C 3/26* (2013.01); *B65B 3/06* (2013.01); *B65B 3/18* (2013.01); *B65B 3/26* (2013.01);
(Continued)

(58) Field of Classification Search
CPC ..... B67C 3/26; B67C 2003/2671; B67C 2003/2657; B67C 2003/268; B65B 3/06; B65B 3/18; B65B 3/26
See application file for complete search history.

(56) References Cited

U.S. PATENT DOCUMENTS 3,807,463 A * 4/1974 Rademacher ..... B67C 3/281 141/62
3,830,265 A 8/1974 Matejak
(Continued)

FOREIGN PATENT DOCUMENTS

CH 425 509 11/1966
CN 1058936 2/1992
(Continued)

*Primary Examiner* — Nicolas A Arnett
(74) *Attorney, Agent, or Firm* — Gudrun E. Huckett

(57) ABSTRACT

In a method for filling a predefined cylindrical container, a closed filling valve is moved with its filling tip through the container opening into the container. A gas contained in the container is displaced or compressed in the container. The container opening is sealed about the filling valve; the point in time of sealing determines a pressure in the container. The container is filled by opening the filling valve to allow fluid flow. The end face of the filling valve is below a fluid level in a radial gap volume between container wall and filling valve. Upward movement of the filling valve is adjusted according to predefined control parameters; filling occurs below fluid level in that the fluid level is above the end face of the filling valve. The filing valve is closed upon reaching the predefined filling volume. The closed filling valve is removed from the container.

38 Claims, 12 Drawing Sheets

(51) Int. Cl.
*B65B 3/18* (2006.01)
*B65B 3/26* (2006.01)

(52) U.S. Cl.
CPC ..... *B67C 2003/268* (2013.01); *B67C 2003/2657* (2013.01); *B67C 2003/2671* (2013.01)

(56) References Cited

U.S. PATENT DOCUMENTS 3,949,791 A 4/1976 Vadas
3,951,186 A 4/1976 Mencacci
4,121,633 A * 10/1978 Diez ..... B01J 8/0015 141/392
4,436,124 A * 3/1984 Borstelmann ..... B67C 3/10 141/37
4,541,463 A 9/1985 Rausing
4,750,533 A * 6/1988 Yun ..... B67C 3/06 141/312
4,915,146 A * 4/1990 Warner ..... B65B 1/363 141/144
4,986,318 A * 1/1991 Yun ..... B67C 3/06 141/147
5,145,008 A * 9/1992 Yun ..... B67C 3/06 141/147
6,192,947 B1 * 2/2001 Ballan ..... B67C 3/005 141/49
9,067,698 B2 * 6/2015 Stolte ..... B08B 9/093
9,783,402 B2 * 10/2017 Leibinger ..... B67C 9/00
10,023,453 B2 * 7/2018 Leibinger ..... B67C 3/204
10,472,217 B2 * 11/2019 Fahldieck ..... B67C 3/206
2001/0010146 A1 8/2001 Brennan et al.
2014/0047797 A1 2/2014 Leibinger
2017/0158481 A1 6/2017 Clüsserath et al.
2017/0297883 A1 * 10/2017 Leibinger ..... B67C 3/204

FOREIGN PATENT DOCUMENTS

CN 1306485 8/2001
CN 204022440 12/2014
DE 10 2011 100 560 3/2012
DE 10 2013 113 070 3/2015
DE 10 2014 014 317 4/2016
GB 1066575 4/1967
GB 2 247 672 3/1992
JP H04 31293 2/1992

* cited by examiner

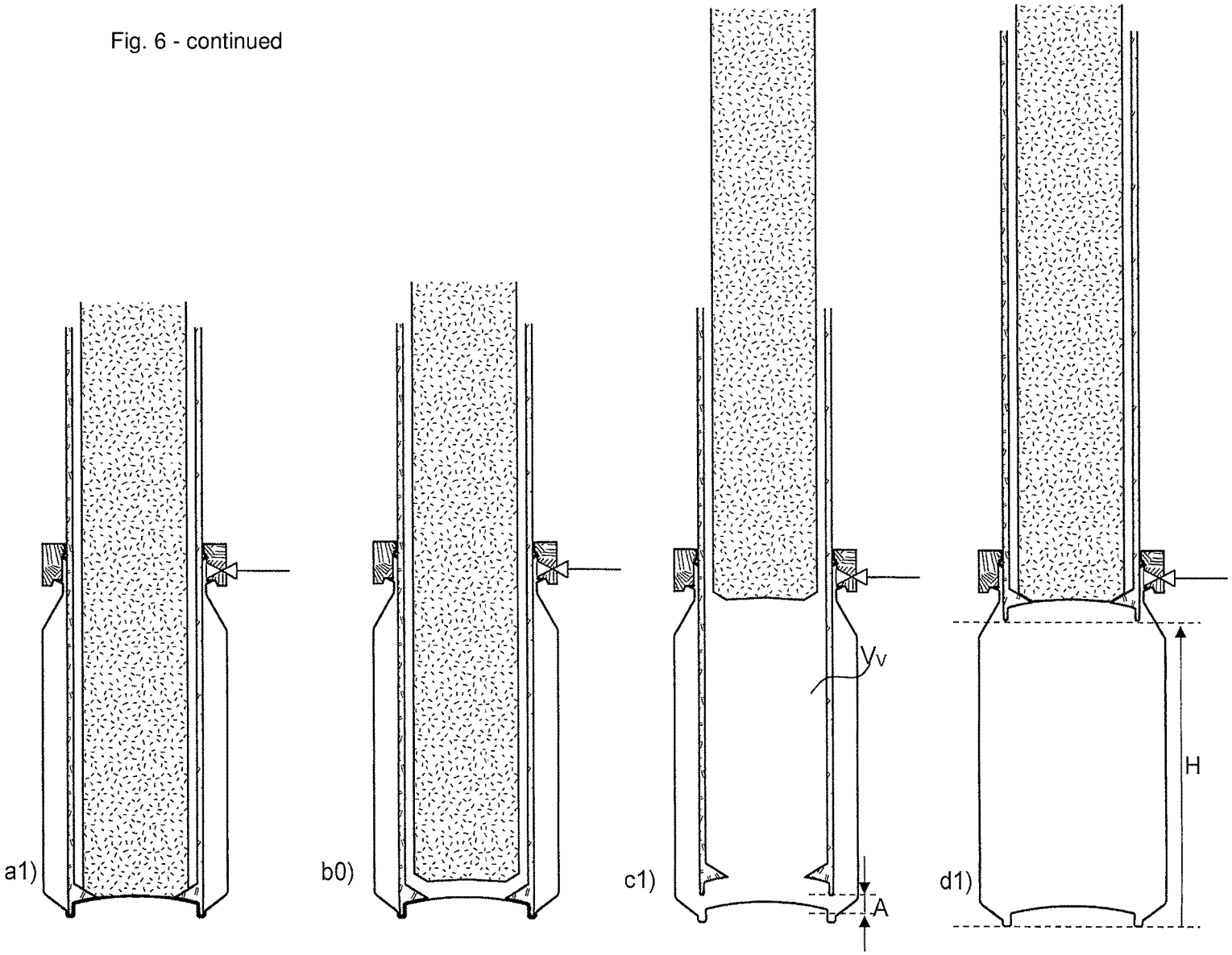
Fig. 6 - continued

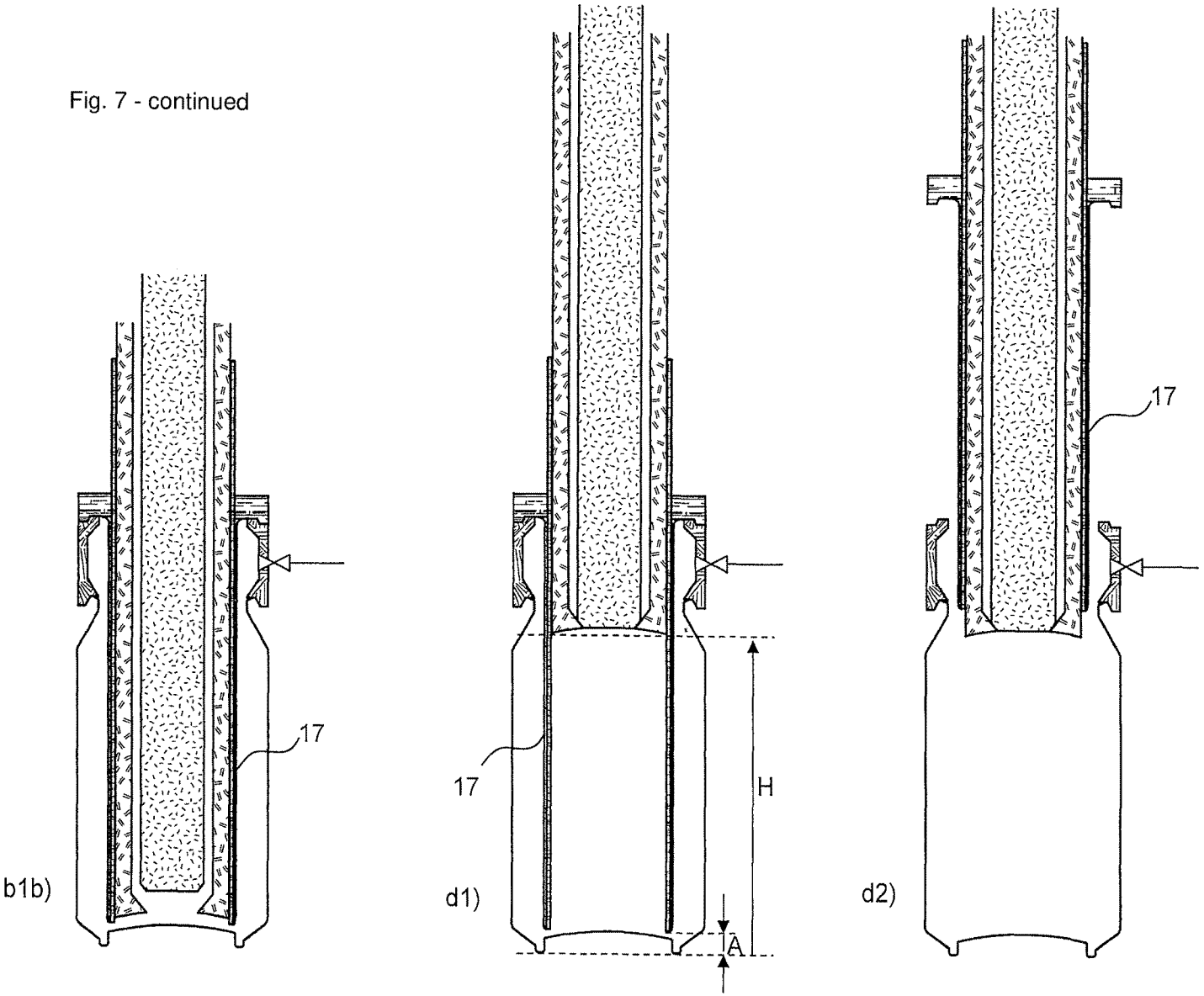
Fig. 7 - continued

METHOD FOR FILLING CYLINDRICAL CONTAINERS, IN PARTICULAR CANS, AND FILLING ARRANGEMENT OF A FILLING DEVICE AND A CONTAINER

BACKGROUND OF THE INVENTION

The invention concerns a method for filling cylindrical containers, in particular cans, with fluid, as well as filling arrangements of filling device and a predefined cylindrical container that are suitable for performing the method.

Filling devices and methods for filling containers are known in various embodiments. In case of oxygen-sensitive liquids, it is to be prevented in this context that the liquid comes into contact with the oxygen of the ambient air and that undesirable gas binding, gas exchange or gas introduction occurs which, due to oxidation reactions or increased germ contamination, may result in a quality change of the liquid. Therefore, containers that are to be filled with such a liquid are, for example, evacuated prior to the actual filling process and/or the container interior is purged with an inert gas etc., for which purpose usually corresponding controllable feeding and discharging gas passages are formed in the respective filling devices.

In order to displace the air oxygen from the container for the filling process, usually a purging process with an inert gas is carried out beforehand; carbon dioxide is usually employed as purging gas in case of filling in carbon dioxide-containing beverages such as beer. For this purpose, the filling devices may comprise, for example, movable tubes and valves so that the purging tube can be inserted into the container prior to a purging gas supply being opened.

Another approach for avoiding the contact with air oxygen is the use of filling devices which comprise a balloon-type expandable body which, enclosing a tube, is inserted prior to the filling process into the container. Through this tube, an expansion medium is introduced into the balloon-type body so that the latter expands until it completely fills out the interior of the container and displaces the ambient air from the container in this way. The liquid which is then fed into the container causes the expansion medium to be pushed out again from the balloon-type body via the tube. A corresponding method and a device are described in DE 10 2011 100 560 B3.

In order to always fill the same filling quantity into the container, the filling quantity for filling the container with a desired filling volume is determined in the prior art by the filling level which is adjusted by the position of the opening of a return air tube or of a return air bore of the filling device or is adjusted by means of sensor (filling level sensor) and actor (valve) and suitable control logic, usually electronically or electro-pneumatically. A further possibility of filling in the same filling quantity into the containers is provided by the control logic by means of flow rate counters (usually magnetic-inductive or by means of the Coriolis force). In this control logic, the container volume is unimportant because the liquid quantity is directly measured. Disadvantage of these measuring devices is their price/performance ratio and that expensive control electronics (PLC) must be very precise, respectively, and therefore expensive actors must be used.

A method and a device for filling a container without measuring means with constant filling level, even in case of varying container shapes, is disclosed in DE 10 2014 014 317 A1. The method provides that a valve attachment, having a gas valve and a liquid valve with valve seats in a housing, is placed seal-tightly on a container and that a displacement element, slidable axially in length direction out of the housing in that it forms with the surrounding valve seats an annular gap, is inserted into the container. By opening the liquid valve, filling fluid flows into the container until even the annular gap is flooded before the liquid valve is closed. The displacement element is pulled out of the container, wherein the liquid volumes flow out of the annular gap into the container. These volumes are precisely as large as the volume of the section of the displacement element in the flooded section so that identical containers are filled with liquid levels of the same height.

U.S. Pat. No. 4,541,463 concerns also filling of a container without measuring means with little turbulence and with exclusion of air in order to prevent foaming. However, the containers therein are hose packagings of paper or plastic which are produced on a tubular mandrel that is slidably arranged about a filling tube. Since the container is produced directly on the mandrel arranged about the filling valve in that a hose is slipped onto the mandrel, is sealed by means of a bottom, and is thus supplemented to a container in this way, this produced container is essentially void of air from the beginning before the filling process is started. The filling tube extends from the bottom of a storage container that rotates relative to a conveying tube provided with a pump whose suction-side end opens below the liquid level in the storage container while the outlet end is successively connected with the filling tubes as a function of the angular position of the storage container in relation to the conveying tube. The pump conveys the liquid when a connection between the outlet side of the conveying tube and the inlet of the respective filling tube is produced. A piston closing off the filling tube is moved, controlled in correlation with the rotational movement of the storage container, in order to open the filling valve when the container has been produced. Prior to opening the filling valve, the mandrel is however moved upwardly so that the container, due to form-fit holding with the bottom holder, is pulled off the mandrel a little bit. In this way, it is to be prevented that the mandrel used for the production of the container comes into contact with the inflowing liquid. With the filling valve open, the bottom holder is moved downwardly and pulls thus the container off the mandrel. The filling action ends when the valve is closed and the conveying tube, due to the rotational movement of the storage container, is no longer in communication with the filling tube.

For filling in foaming liquids such as beer or soft drinks, the container must be moreover pressurized with increased pressure in order to prevent or minimize foaming during the filling process. In so-called counter pressure filling, the respective container to be filled is resting seal-tightly against the filling device so that prior to the actual filling phase usually through a gas passage which is formed in the filling device, pre-pressurization by a pressurization gas under pressure (inert gas or carbon dioxide gas) is carried out. The latter is displaced as a return gas out of the container interior by the liquid flowing into the container during the filling process, which can also be realized by a controlled gas passage formed in the filling device.

The method and the corresponding device for filling containers with a gas-containing liquid known from U.S. Pat. No. 3,830,265 A are said to operate at greater speed without foaming and economic efficiency in order to reduce the space requirement and the costs to a minimum. The method encompasses the displacement of the air contained in the container in that counter pressure gas is introduced into the container prior to the open end of the container being closed seal-tightly so that the container, after a filling piston that is filled with a pressurized pre-metered liquid quantity has been introduced through the open end of the container, by means of a counter pressure gas can be pressurized with counter pressure which corresponds to the pressure of the liquid and is greater than the atmospheric pressure. By opening the filling piston, a first portion of the liquid contained in the piston is supplied to the container by means of the force of gravity so that the counter pressure gas contained in the unused space of the container is displaced. By retracting the filling piston, the container is filled with the residual portion of the liquid from the piston, wherein the liquid, which flows back from the container in a return air tube after the counter pressure gas contained therein has been completely displaced, is controlled with a valve.

DE 10 2013 113 070 B3 concerns a filling device which enables a high-purity filling by optimized separation of a clean space from a region with lower purity requirements and, due to the improved sealing action, is provided in particular for counter pressure filling of cans. This is achieved by a sealing tulip which, as is conventional in a filling device, encloses the container opening and the discharge opening of the filling device but now comprises two sealing elements, one of which seals the transition between the sealing tulip and the housing of the filling device and the second one, arranged at the free end which is facing the container in the filling arrangement, surrounds the first sealing means radially outside of a control means at the outer circumference and seals in this way the transition between the sealing tulip and the separation location between the clean space region and the other region.

The reduction of ambient air oxygen in the container interior required for filling containers such as cans, the provision of the pressurization pressure required for counter pressure filling, and monitoring and maintaining the correct filling quantity lead to a complex construction of the filling device and to a failure-prone filling process.

Based on this prior art, it is the object of this invention to provide a reliable and simplified method for the filling of (substantially) pre-manufactured cylindrical containers such as cans in which the consumption of purging and pressurization gases is reduced and to enable filling of substantially cylindrical containers such as cans with a device of simplified apparatus construction and with reduced oxygen absorption even without a purging step, without necessitating a return air tube or a return air conduit or complex measuring and control technology.

SUMMARY OF THE INVENTION

This object is solved by the method for filling a predefined cylindrical container with a fluid by using a filling device for the predefined cylindrical container whose concentric container opening comprises a diameter which amounts to 70 to 99.5% of the container interior diameter, wherein the filling device comprises a filling valve that comprises a piston controllably guided in a filling tube, wherein the filling valve relative to the container is movable and comprises an outer diameter that is embodied to match the diameter of the container opening so that a filling tip of the filling valve can be inserted and retracted coaxially into/from the container through the container opening with little play but without contact and without friction, wherein the filling tip of the filling valve intended for insertion comprises a volume which in the container occupies a volume in the range of 49 to 99% of the container volume; the method comprising the steps:

a) performing a relative movement between the closed filling valve and the container, wherein the filling tip of the filling valve is received through the container opening in the container, wherein gas contained beforehand in the container is displaced in accordance with a volume of the received filling tip of the filling valve out of the container or is compressed in the container;

b) opening the filling valve and allowing flow of the fluid into the container so that an end face of the filling valve facing the container bottom with the valve opening is located below a fluid level in a gap volume between a container wall and the filling valve;

c) matching a relative upward movement of the filling valve within the container up to the container opening according to a predefined control parameter, which takes into consideration the predefined filling volume in the container, wherein a filling process below fluid level is obtained in that the fluid level in the gap volume during the filling process during the upward movement is positioned above the end face of the filling valve;

d) closing the filling valve when the predefined filling volume in the container is reached, and e) removing the closed filling valve from the container.

A further object of the invention is to provide a device of simplified apparatus construction which enables filling of cylindrical containers or at least substantially cylindrical containers such as cans with reduced oxygen absorption even without purging step and without complex measuring and control technology.

This object is solved by the filling arrangement of a filling device and a predefined cylindrical container for performing a method in accordance with the invention, wherein a concentric container opening of the predefined cylindrical container comprises a diameter that amounts to 70 to 99.5% of the container interior diameter, wherein the filling device comprises a filling valve that comprises a piston which is controllably guided in a filling tube; wherein the filling arrangement is characterized in that:

the filling valve comprises an outer diameter which is embodied to match the diameter of the container opening so that a filling tip of the filling valve is insertable and retractable coaxially into/from the container through the container opening nearly without play but without contact and without friction, and the filling device provides for a relative movement between the filling valve and the container, wherein a filling tip of the filling valve is insertable coaxially into the container through the container opening, wherein the filling tip of the filling valve intended for insertion comprises a volume that occupies in the container a volume in the range of 49 to 99% of the container volume, wherein the filling device comprises a control action without return air tube.

Further developments of the method and of the device are disclosed in the dependent claims.

The basic concept of the invention is based on the use of a filling device with a filling valve, which comprises a piston which is controllably guided in a filling tube, for filling a predefined cylindrical container whose concentric container opening has a diameter which amounts to 70 to 99.5% of the container interior diameter, as is the case, for example, with 80 to 90% of the most frequent standard sizes of the beverage cans. The latter are manufactured very precisely with regard to their volume of a metal such as aluminum or tin. Cylindrical containers are to be understood in this context also as the can-typical shapes in which the upper end tapers slightly conically toward the filling opening. Also, cylindrical containers are to be understood not only as the typical circular cross-section but also shapes deviating therefrom, for example, elliptical or polygonal cross-sectional shapes, are to be encompassed. Important is that the filling opening is concentric to the cross-sectional shape of the container and has a shape that is congruent thereto whose dimensions correspond to approximately 70 to 99.5% of the cross-sectional dimensions of the container. According to the invention, the filling valve now comprises an outer diameter which is embodied to match the diameter of the container opening so that a filling tip of the filling valve (filling tip is to be understood in this context as the entire section of the filling valve which can be accommodated in the container) can be received coaxially without friction but also with little play, in the meaning of almost without play, through the container opening in the container when a relative movement between the filling valve and the container relative to each other is performed. In this context, this can be the introduction of the filling valve into the container; however, the container can also be axially moved by means of a corresponding movable container receptacle in the direction toward the filling valve in order to accommodate the filling valve in the container so that in both cases the introduced section of the filling valve, even without expandable balloon elements, occupies in the container a volume which, as a function of the filling valve diameter, amounts to up to 99% of the container volume. In this way, either the ambient air (and thus oxygen) which is contained in the container can be displaced by up to 99% out of the container so that purging gas can be omitted or the use thereof can be at least minimized. Or, the ambient air which is present in the container is compressed upon insertion of the filling valve when the container opening is sealed so that the pressure in the container rises and pressurization gas can be omitted; in any case, the quantity of pressurization gas can be significantly reduced because the pressure generation is realized by the mechanical displacement by means of the filling valve.

A first embodiment of a method according to the invention for filling a cylindrical container whose concentric container opening comprises a diameter which amounts to approximately 70 to 99.5%, preferably 80 to 90%, of the container interior diameter, provides the following steps:

a) First a relative movement between the closed filling valve and the container relative to each other is performed so that the filling valve is introduced through the container opening into the container (or the container with its opening is slipped across the filling valve) until the filling tip of the filling valve is accommodated in the container. Preferably, the filling tip is received as deep as possible, optionally up to the point of the end face of the filling valve contacting the bottom of the container in order to achieve a greatest possible displacement/compression of the air (or another gas) contained in the container. For contacting, the end face of the filling valve can be shaped in accordance with the bottom of the container or can comprise spacers etc.

This procedure is possible because the geometric parameters (dimensions such as diameter, height, exact wall thickness) of a can as a predefined container are completely known and because the dimensions (in particular) of the filling tube are matched to the can.

Due to the diameter of the filling valve that is matched to the container opening, a major portion of the container volume is occupied by the filling valve as a result of the minimal diameter difference between the container opening and the container, and the gas (air) contained in the container is displaced in this way. Accordingly, the quantity of air oxygen contained in the container in the remaining gap volume between container wall and filling valve is also reduced already purely mechanically. The use of a purging gas such as nitrogen or carbon dioxide can therefore be reduced; optionally, it can be completely omitted.

b) For allowing flow of the fluid into the container or into the annular gap volume, the filling valve is opened by transferring the piston into an open position and an upward movement of the filling tube with the piston in open position is performed so that the end face of the filling valve facing the container bottom is positioned with the valve opening below a fluid level in the gap volume that is formed between a container wall and the filling valve. Optionally, in case of a filling valve which is contacting the bottom, it can be provided in this context that the end face of the filling valve, more precisely of the filling tube, is provided with channels which enable flow of the fluid after opening of the valve already at the time when the end face of the filling valve is still contacting the bottom of the container, prior to the open filling valve being moved upward. The fluid that has flowed in has contact with the gas contained in the container only within the gap volume. Since due to the geometric conditions of the filling arrangement this contact surface is very small, the absorption into the fluid is extremely minimal even in case of the presence of air oxygen. Moreover, this is a filling process below fluid level from bottom to top which is characterized by minimal swirling and turbulences whereby a further reduction of possible oxygen absorption is achieved.

c) In this context, a relative upward movement of the filling valve within the container (depending on the embodiment, this is realized by movement of the filling valve or of the container) up to the container opening is adjusted during the filling process according to a predefined control parameter which takes into consideration the predefined filling volume in the container so that the filling volume is reached when the filling valve reaches the region of the container opening, wherein a filling process below liquid level is achieved in that the liquid level in the gap volume during the filling process during the upward movement is positioned above the end face of the filling valve.

d) The filling valve is closed when the predefined filling volume in the container is reached.

e) The closed filling valve is retracted in order to perform the method in the next container.

In principle, filling processes can be differentiated based on whether in step a) the gas is displaced from the container when the container opening about the filling valve is not sealed or is compressed in the container when the container opening is sealed about the filling valve.

As an alternative to direct contacting or indirect contacting, by spacers or the preferably employed annular seal, of the bottom by the filling valve for complete accommodation in the container, it can be provided that the filling valve is accommodated up to a predefined distance relative to the bottom of the container which ensures that the container bottom is not deformed by contact with the filling valve.

The described advantages of the method according to the invention, which result from an adaptation of the filling valve diameter to the filling opening diameter of a container with a small difference between container diameter and opening diameter, are further improved by a further embodiment in which the filling valve comprises in addition a separation tube about the filling tube that can be controllably moved independent of the filling tube and of the piston. The outer diameter of the filling valve is determined in this context by the separation tube which surrounds the filling tube and is matched correspondingly to the diameter of the container opening. In this way, a use of conventional filling valves is also made possible by retrofitting a separately movable separation tube in that by means of the separation tube the diameter of the filling valve is matched to the container opening. If needed, a filling valve can be matched also in this way to different container openings by use of corresponding different separation tubes.

In the embodiment of the method which can be performed with this filling valve, it is provided that, in case of the filling valve accommodated with the entire filling tip in the container in step a), an axial gap of, for example, 3 to 5 mm between the lower end of the separation tube and the container bottom remains in order to allow the fluid to flow into the annular gap volume between container wall and separation tube after opening the filling valve. In a preferred embodiment, the unilaterally acting annular seal can be arranged in the axial gap. Step b) now is divided into several sub-steps:

b0) For opening the valve, the piston is transferred into the open position so that the fluid can flow into the radial gap volume between the container wall and the separation tube. Fluid flows into the radial gap volume until a pressure compensation between the pre-adjusted filling pressure and a predefined container pressure is present, whereby a filling level in the radial gap volume is determined.

b1) A relative upward movement of the filling tube, with the piston in open position, is performed within the separation tube which remains in this context in its completely inserted position in which it has the axial gap relative to the bottom. With the upward movement of the filling tube with the piston in open position, the separation tube is filled with fluid.

b2) At a predefined height, located between container bottom and container opening, the upward movement of the filling tube is terminated and the piston transferred into closed position.

c) Here also, the upward movement of the filling valve, or of the filling tube with piston, inside the container up to the container opening is adjusted according to a predefined control parameter that takes into consideration the predefined filling volume in the container.

d1) When the radial gap volume is completely filled and in step b2) the predefined height is within a region of the container opening and the container is completely filled, the retraction of the separation tube is performed, and subsequently in step e) the retraction of the closed filling valve with separation tube in order to be able to supply the next container for filling.

In case that in step b0) the filling level that is achievable in the radial gap volume is smaller than a maximum filling level in the radial gap volume (complete filling of the gap volume) that is predefined by the container, the method comprises moreover the steps:

a1) performing, after step b2) and prior to d1), a relative downward movement of the filling tube with the piston in closed position, wherein the fluid volume which is present in the separation tube up to the predefined height is pushed through the axial gap into the radial gap volume and the filling level rises therein.

Optionally, the steps b0) to a1) can be repeated until in step a1) the gap volume is filled completely to the maximum filling level.

c1) Then a relative upward movement with the filling tube with the piston in closed position is performed within the separation tube up to the predefined height which is then in a region of the container opening, wherein the separation tube is filled again with fluid. However, the separation tube can also be moved concertedly with the filling valve relative upwardly so that the radial gap volume is completely filled. However, the opening of the separation tube should remain always below the filling level of the liquid in this context.

d1) after closing the filling valve in the region of the container opening in accordance with step b2), the retraction of the separation tube is carried out wherein the fluid present in the separation tube remains in the container.

Preferably, in a method step prior to the actual filling process, for complete filling of the radial gap volume in a single step a1), a first height in the radial gap volume can be set and thus predetermined in a first step b) as a function of the achievable filling level in step b0), which is also known based on the pre-adjusted filling pressure and the predefined container pressure, so that the volume, which is limited in the separation tube by the filling tube at the first predefined height, corresponds to a volume difference of the gap volume between the maximum filling level and the achievable filling level.

Aside from the minimized contact surface and the reduced oxygen absorption correlated therewith and the mechanical displacement of the gas present in the container upon introduction of the filling valve, primarily the filling process below filling level is improved by the separation tube so that quasi laminar flow conditions can be achieved. Since the fluid level in the gap volume rises therefore extremely calmly without turbulences, the oxygen absorption at the contact surface is further reduced.

According to an embodiment of the method, the predefined control parameter in step c) can be a preadjusted filling time which is derived from a predefined filling volume in the container and an adjusted filling volume flow of the filling device. The predefined filling volume corresponds in case of cans to a nominal volume because cans, different from bottles, can be manufactured very exactly. Therefore, closing of the filling valve in step d) is carried out after the predefined filling time. For control of the filling process, the filling time can thus be predefined prior to the filling process and, in a method step for setting up the filling device, can be input into its control device. Also, the predefined height at which the upward movement of the filling valve or of the filling tube is terminated and the piston is transferred into the closed position can be used for controlling the filling process and can be input accordingly into the control device.

Advantageously, the method according to the invention that employs the filling arrangements according to the invention can be performed essentially without measuring means; measuring devices or measuring means that are required in the prior art are not needed. The adjustment and monitoring of the desired filling volume by means of a control instrument, such as a magnetic-inductive flow rate meter or by means of a filling level determination, is not required.

In a further embodiment of the method for counter pressure filling, it is also possible to fill in foaming or carbon dioxide-containing fluids such as beer or soft drinks. In this context, it is provided that a0) at a point in time prior to or during step a), i.e., also prior to the actual filling process, sealing of the container opening about the filling valve is carried out for configuring the filling device for the intended filling process, for example, in that an annular sealing element, for example, a sealing tulip, is attached which seals the transition between filling valve and container at the container opening. In this context, the point in time of the sealing action prior to or during the insertion of the filling valve determines the pressure which is present in the sealed container after complete insertion of the filling valve. The desired pressure can be adjusted based on the geometric dimensions of the filling valve and of the container, for which purpose in approximation the Boyle-Mariotte law can be employed that the pressure of ideal gases at constant temperature and constant mass is inversely proportional to the volume: p*V=const. Based on the indicated geometric dimensions, such as the volume of the empty container and the volume difference that is determined by the volume of the section of the filling valve that has penetrated to a respective level, the corresponding length of the penetration depth of the filling valve can be determined for a predefined pressure.

In a further embodiment of the method according to the invention, it is provided that for configuring the filling device a volume compensation attachment can be inserted seal-tightly about the filling valve between the container opening and the sealing element when sealing the container opening. The volume compensation attachment is embodied such that a volume of an annular gap, which is formed in the volume compensation attachment between its wall and the filling valve, corresponds to a displaced volume that is caused by a portion of the filling valve that is still located inside the container upon closing of the filling valve in step d). The volume which is present in the container corresponds in this case to the difference between the predefined filling volume and the displaced volume. In order for the predefined filling volume to be present in the container after the retraction of the closed filling valve in step e), the fluid volume which has flowed upon filling of the container according to steps b) and c) into the annular gap of the volume compensation attachment and which corresponds to the displaced volume is allowed to flow into the container upon retraction of the closed filling valve in step e).

A further embodiment provides that the sealing element or, if used, the volume compensation attachment comprises a check valve or overflow valve. In this way, it is prevented that the pressure in the container surpasses a highest pressure predefined for the filling process. A further reduced oxygen introduction is realized due to a low excess pressure, which is kept constant during counter pressure filling, in interaction with the reduced contact surface and the low-turbulence filling. In particular in the variant of the filling process that employs the filling device with separation tube about the filling tube, the pressure can thus be kept constant even for the "pumping step" when the fluid volume which is present in the separation tube below the closed filling tube is pushed into the annular gap by the relative downward movement of the closed filling tube. Moreover, upon displacement of the gas which is present still in the gap volume, it is ensured due to the check valve or overflow valve due to this post pressurization or pumping that the oxygen absorption remains minimal or is further reduced, wherein due to this post pressurization also a very fast essentially "laminar" filling process below liquid level is achieved.

In an alternative embodiment of the method, a filling valve with a combined separation/filling tube is employed that, for identical outer diameter which is embodied to match the diameter of the container opening, has a greater inner diameter than the above filling tubes and is thus thin-walled. The correlated controllably guided piston has a diameter which is matched to the enlarged inner diameter of the separation/filling tube, i.e., is also enlarged. Moreover, the piston guide and piston control in the separation/filling tube are designed such that the piston, in addition to the open position in which, for allowing flow of the fluid, the piston is arranged proximal to, i.e., closest to a sealing seat of the separation/filling tube, and thus corresponds to a normal open position of a valve, comprises at least a second open position in which the piston is arranged distal to, i.e., farther removed from, the sealing seat of the separation/filling tube so that within the separation/filling tube a displacement volume can be provided which supplements the fluid volume that has flowed into the gap volume to the predefined filling volume. The position of the piston in the second open position thus depends on the height of the predefined container and on the diameter difference between container and separation/filling tube because it is provided that, in the second open position, the piston end, when the separation/filling tube is completely received in the container and substantially extends to the container bottom, is positioned in the region of the container opening so that the sum of the fluid volume present in the separation/filling tube and of the fluid volume in the gap volume results in the filling volume for the predefined container.

In this method, the predefined control parameter in step c) is also a filling time which is matched to the movements of the filling valve. This embodiment comprises the following steps:

b0) After complete insertion of the filling valve in step a), the piston is transferred into the first open position of the filling valve for allowing flow of the fluid into the radial gap volume between the container wall and the separation/filling tube, and b1.1) an upward movement of the separation/filling tube with the piston in open position is performed, wherein the fluid continues to flow into the radial gap volume until in the radial gap volume a filling level, that depends on the pre-adjusted filling pressure and a pre-definable container pressure, is reached that has been predefined prior to the filling process.

b2) At a second predefined height, the upward movement of the separation/filling tube is terminated and the piston is transferred into closed position. The second predefined height is determined here also, prior to the actual filling process, as a function of the filling level in the radial gap volume achievable in b1.1) so that a volume that is limited below the separation/filling tube at the second predefined height corresponds to a volume difference of the gap volume between the maximum filling level and the filling level which is achievable in b1.1)

a1): The separation/filling tube with the piston in closed position is again completely inserted wherein, due to the post pressurization or pumping, the gas that is present in the gap volume is compressed and is displaced via the pressure relief valve so that here also the oxygen absorption remains minimal or is further reduced.

After repeating step b0), the transfer of the separation/filling tube is carried out in step c1) into a position in which an axial gap of 3 to 5 mm between the lower end of the separation/filling tube and the container bottom remains. The separation/filling tube remains in this position while the piston is transferred into the second open position of the filling valve, which is located in the region of the container opening, and in doing so the separation/filling tube is filled with the predefined displacement volume of fluid. Upon retraction of the separation/filling tube (step d1)), the piston is moved into the closed position and the fluid passes from the displacement volume of the separation/filling tube into the container so that the container is completely filled, and in step e) the closed filling valve is retracted for filling the next container.

Even though by the above measures an oxygen absorption from the air can be significantly and, in many cases, sufficiently reduced, a further reduction of the oxygen contact may be required for fluids that are particularly oxygen-sensitive. In order to be able to also eliminate a purging step here, in a further embodiment of the method it is provided that the filling valve comprises an elastically expandable body at least at one section or about a section which in step a) is completely inserted into the container. For example, a balloon body can be arranged so as to radially surround the filling tube, separation tube or separation/filling tube in the corresponding region.

In this context, the method comprises the steps:

a1) After in step a) the closed filling valve has been introduced completely through the container opening into the container, the elastically expandable body is allowed to expand. This can be realized actively by introduction of a gas into the elastically expandable body; in cases in which the container is sufficiently stable in regard to external pressure and is also made of a material that is more pressure-resistant than the elastically expandable body, after complete insertion of the filling valve, whereby air has been displaced, and after sealing of the container, a vacuum causing expansion of the elastically expandable body can be generated in the container by retraction of the filling valve or of the filling tube with the piston in closed position in the separation tube. The expansion is continued until the elastically expandable body a2) contacts the inner surfaces of the container and, if used, the inner surface of the volume compensation attachment wherein the entire air is pushed out of the container through the valve.

b1) Transfer of the piston into the open position of the filling valve follows to allow fluid to flow in, wherein the elastically expendable body a) is compressed until it b) is again contacting the filling valve and the radial gap volume between the container wall and the filling valve is filled and, if used, the annular gap between the volume compensation attachment and the filling valve is filled.

b2) Subsequently, an upward movement of the filling tube with the piston in open position is carried out up to a predefined height in a region of the container opening.

In case of a filling valve in which the elastically expandable body is arranged at or about the separation tube, during step b2) the separation tube is maintained in the completely inserted position during the upward movement of the filling tube with the piston in open position and the separation tube is filled with fluid. In the following step d1) the filling valve is closed or the piston is transferred into the closed position when in step b2) the predefined height in the region of the container opening is reached so that the sum of the volumes within the separation tube and the gap between container and separation tube and optionally of the volume compensation attachment constitute the predefined filling volume so that, by retraction (d2) of the separation tube, the fluid volume of the separation tube passes into the container and, if used, the volume of the volume compensation attachment flows into the container upon opening of the seal so that the container is completely filled when in step e) the closed filling valve is retracted.

A filling arrangement according to the invention is comprised correspondingly of a filling device and the cylindrical container whose concentric container opening has a diameter which amounts to 70 to 99.5% of the container interior diameter. For filling such predefined containers—predefined because they are known with regard to shape and volume—with a fluid, a filling device with a filling valve is used that, as usual, comprises a piston which is controllably guided in a filling tube. According to the invention, in this context the filling valve is configured such that the outer diameter of the filling valve is embodied to match the diameter of the container opening, i.e., is designed to be slightly smaller so that the coaxial insertion of the filling valve into the container through the container opening can be performed almost without play, for example, with a maximum radial play of 1 mm, but the filling valve can still be inserted and pulled out without contact and without friction.

The filling valve will usually comprise also a circular cross section in accordance with the usual circular cross-sectional shapes of the container such as cans. When the shape of the container to be filled and of the container opening deviates from the circular shape, the outer contour of the filling valve is matched thereto so that here also the insertion of the filling valve into the container is virtually without play at the container opening.

The filling device of a filling arrangement according to the invention is configured such that the filling valve and the container can be moved relative to each other wherein correspondingly the filling valve or a container receptacle is movable. The arrangement ensures in this context that the filling tip of the filling valve is introduced coaxially, i.e., centered, into the container through the container opening. With the geometric conditions of the container diameter, of the opening diameter, and of the filling valve diameter, it is achieved that by means of the inserted filling tip of the filling valve a volume is occupied in the container that is in the range of 49 to 99% of the container volume and can ensure a corresponding displacement or compression. The filling tip of the filling valve intended for insertion has thus a volume that occupies in the container a volume in the range of 49 to 99% of the container volume. According to the invention, the filling device has no return air tube. The control without return air tube is enabled due to the knowledge of the exact volume conditions of the predefined container and of the correspondingly adjusted filling device because for containers such as cans, which are manufactured with always identical shape, diameter, and height, the predefined filling volume corresponds to the nominal volume and therefore the filling level in the container obtained with the predefined filling volume is always constant, in contrast to bottles, for example.

The control action can therefore be configured such that the filling arrangement can be controlled as a function of only a predefined filling time and/or a predefined height in/at which the upward movement of the filling tube is terminated and the piston is transferred into the closed position so that the control action not only is without return air tube but also is substantially without measuring means.

The filling time as a pre-adjusted control parameter is derived from the predefined filling volume in the container and an adjusted filling volume flow of the filling device. The rate of upward movement of the filling valve is then matched to the predefined filling time and closing of the filling valve is realized after the predefined filling time. Likewise, the predefined height at which the upward movement of the filling valve or of the filling tube is terminated and the piston is transferred into the closed position can be used as a pre-adjusted control parameter for controlling the filling process and correspondingly can be input into the control device. No measuring devices or measuring means required in the prior art are necessary for such a control action.

In a preferred embodiment, the filling arrangement can comprise the filling valve that comprises, about the filling tube at the filling tip, a separation tube that can be displaced controllably independent of the filling tube and the piston.

The outer diameter of the filling valve which is embodied to match the container diameter is determined in this context by the separation tube. With the separately movable separation tube, a filling process can be performed in accordance with the invention that is particularly advantageous and will be described in the following.

Alternatively, the filling tube can be embodied as a combined separation/filling tube whose outer diameter is embodied to match the diameter of the container opening. However, the combined separation/filling tube is of a thin-walled configuration and, in comparison to a conventionally dimensioned filling valve, comprises an enlarged inner diameter. Therefore, the controllably guided piston is embodied as a correspondingly widened piston whose diameter is matched to the inner diameter of the separation/filling tube. It is import in this embodiment with which a method according to the invention can be performed also that the piston, in addition to a first open position in which the piston is arranged proximal to, i.e., closest to a sealing seat of the separation/filling tube, has at least a second open position in which the piston is arranged distal to, i.e., remote from the sealing seat of the separation/filling tube, and an enlarged travel stroke of the piston in the separation/filling tube is provided in this way. The position of the piston in the second open position is dependent in this context on the height of the predefined container and the diameter difference between container and separation/filling tube because it is provided that the piston end in the second open position, when the separation/filling tube is completely accommodated in the container and substantially extends down to the container bottom, is in the region of the container opening so that the sum of the fluid volume present in the separation/filling tube and of the fluid volume in the gap volume constitutes the filling volume for the predefined container.

In particular when with the filling arrangement filling by means of counter pressure filling is to be realized, the filling arrangement can comprise a sealing element that is arranged at the container opening about the filling valve, i.e., about the filling tube, about the separation tube or about the combined separation/filling tube, depending on the embodiment.

Optionally, the filling arrangement can comprise in addition a volume compensation attachment that is arranged between the sealing element and the container opening about the filling valve (filling tube, separation tube or combined separation/filling tube). In order to prevent an undesired pressure increase in the container during filling, the seal or the volume compensation attachment can comprise a valve, preferably a check valve or overflow valve.

Moreover, the filling valve can comprise at an end face facing the container bottom radially extending flow channels in order to allow fluid to exit from the open filling valve that contacts the container bottom, wherein the end face is provided at the filling tube, at the separation tube or at the combined separation/filling tube, depending on which filling valve is used. Such a complete accommodation of the filling valve down to the point of contacting the bottom is advantageous for a maximum displacement/compression. For contacting, the end face of the filling valve can moreover be shaped in accordance with the contour of the container bottom. However, in connection with contacting of the container bottom, an exact control action of the relative movement must be observed in order to prevent that the container becomes deformed and thus damaged. Since the exact container geometry determines the filling volume, it is particularly important that no deformations occur at the container which lead to a container volume change. Therefore, it may be preferred that the filling valve at an end face of the filling tube, of the separation tube or of the combined separation/filling tube that is facing the container bottom has a circumferentially extending spacer or several distributed spacers that are embodied to be elastic/springy and can thus contact the container bottom without risking deformation thereof.

Particularly preferred, a circumferentially extending unilaterally acting annular seal with valve function such as a sealing lip can be employed in this context that not only acts as a springy spacer but also opens in one direction in order to allow flow of fluid out of the filling valve into the container, while sealing in opposite direction, and in this way prevents a return flow—or when the container pressure is higher than the filling pressure—also penetration of gas from the container into the region below the filling valve opening.

According to one embodiment, in order to displace the air contained in the container completely, it can be provided that the filling valve comprises an elastically expandable body along the insertable filling tip at least at one section or about a section of the filling tube or of the separation tube (or of the combined separation/filling tube).

In order to assist in the coaxial centered reception of the filling valve through the container opening, the filling valve may moreover comprise at the filling tip a centering section which tapers toward the end face.

A further embodiment can provide that the filling tube and the piston each comprise an exchangeable filling tip section so that, without long interruption of the filling operation, the filling valve quickly and simply can be renewed, for example, in case of occurring signs of wear, or matched—with other geometries—to other containers by exchange of the tip sections.

For an improved guiding action, the filling tube or the piston may moreover comprise at least one glidingly designed radial spacer device for centering the piston in the filling tube.

A further embodiment of the filling device according to the invention ensures a further improvement of the filling process in that, by a directed flow, inclusion of gas bubbles is minimized which, at the end of the filling process, would lead to undesirable foaming. For this purpose, the filling valve comprises, at one inner side of the filling tube or at an outer side of the piston or at both, above the respective sealing surfaces a flow guiding structure that is designed such that fluid exiting from the filling valve is imparted with a swirling or vortex movement. Due to the rotating flow of the fluid it is prevented that the fluid impacts radially against the lateral container wall and rebounds thereat whereby gas bubbles would be enclosed that, upon upward movement of the filling valve, might accumulate and might cause increased foaming. The rotating flow produces significantly fewer gas bubbles which moreover are smaller and are located near the surface of the rising fluid level so that they collapse prior to the filling process being terminated, whereby the increased foaming action is prevented.

The flow guiding structure can be formed, for example, by one or several coil webs similar to a thread or formed by a vane structure.

The vane structure can be embodied by an annular arrangement of guide vanes that are curved at least in one plane, i.e., in circumferential direction relative to a radial plane. The guide vanes can however also be curved in two planes, i.e., in circumferential direction and in longitudinal direction in relation to the radial plane.

As an alternative, when the piston of the filling valve is designed to rotate, the vane structure can be formed by an annular arrangement of moving vanes that may be curved or uncurved and are arranged at the rotatable piston. In case of curved moving vanes, advantageously no drive is required because the fluid flowing past causes the piston to rotate. In case of uncurved moving vanes, the piston is driven for rotation.

As needed, the radial spacer device can be designed as a flow guiding structure so that advantageously one element fulfills two functions.

BRIEF DESCRIPTION OF THE DRAWINGS

Further embodiments as well as some of the advantages that are correlated with these and further embodiments will be more clearly and better comprehensible by means of the following detailed description with reference to the accompanying drawings. Objects or parts thereof which are substantially identical or similar may be provided with the same reference characters. The Figures are only a schematic illustration of an embodiment of the invention. It is shown in this context in.

DESCRIPTION OF PREFERRED EMBODIMENTS

Figure 1:
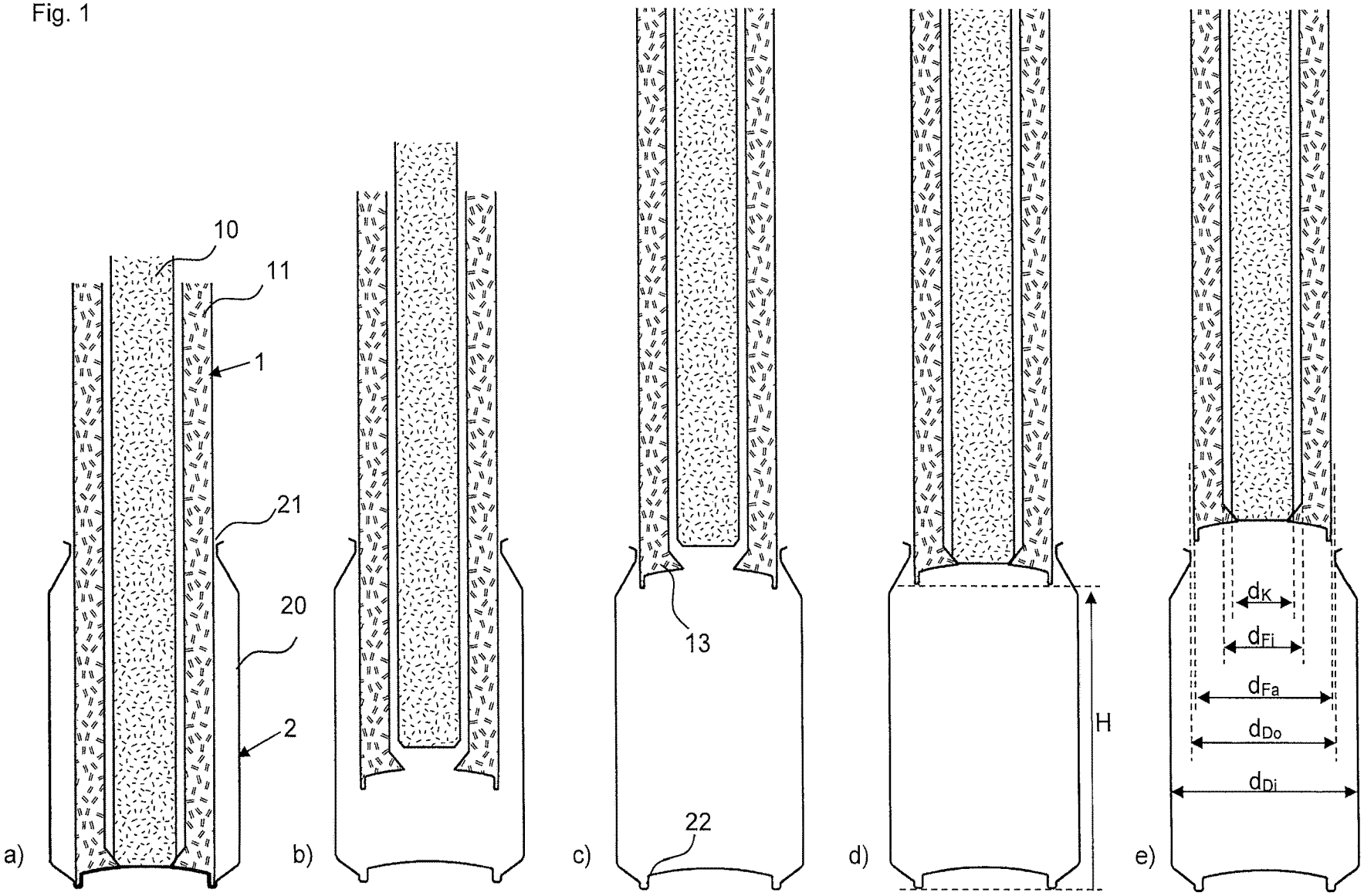
FIG. 1 sectioned side views of a filling arrangement according to the invention with a filling valve of filling tube and piston according to steps a) to e) of an embodiment of the method according to the invention.

The invention concerns filling of cylindrical containers—for example, cans—by means of a special filling arrangement. In this context, advantage is taken of the fact that cans, which in addition to bottles and cartons are the most important packaging for beverages, primarily for carbon dioxide-containing beverages such as beer or soft drinks, have an extremely precisely produced cylindrical shape with a coaxial filling opening that is only minimally smaller than the container diameter. The most commonly used can volumes in Europe are 0.33 l and 0.5 l, but there are also cans with a volume of 0.15 l, 0.2 l, and 0.25 l, as well as 1 l and 5 l. According to the invention, however, also containers with other volumes can be filled as long as the container volume is known.

In the Figures, respective sequences of the filling arrangement in different method steps are illustrated; reference characters are therefore not provided in each illustration of the filling arrangement. The correlation with the components and objects without label is however easily apparent due to the equivalence of the illustrations.

FIG. 1 shows a simplest embodiment of the method and of a filling arrangement suitable therefor which is comprised of the filling valve 1 and the container 2. In this context, a can is provided here whose substantially cylindrical shape at the upper end tapers slightly toward the coaxial filling opening 21. The taper serves primarily for receiving the cover, not illustrated here, which after completion of the filling process is attached and connected by (multiple) crimping with the rim of the can. The method according to the invention uses this difference between container (interior) diameter $d_{Di}$, and the diameter $d_{Do}$ of the container opening 21.

The diameter $d_{Do}$ of the container opening 21, as shown in the illustrated example of FIG. 1, can amount to between 70 and 99.5%, usually between 80 to 90% of the container interior diameter $d_{Di}$.

Figures 8, 11:
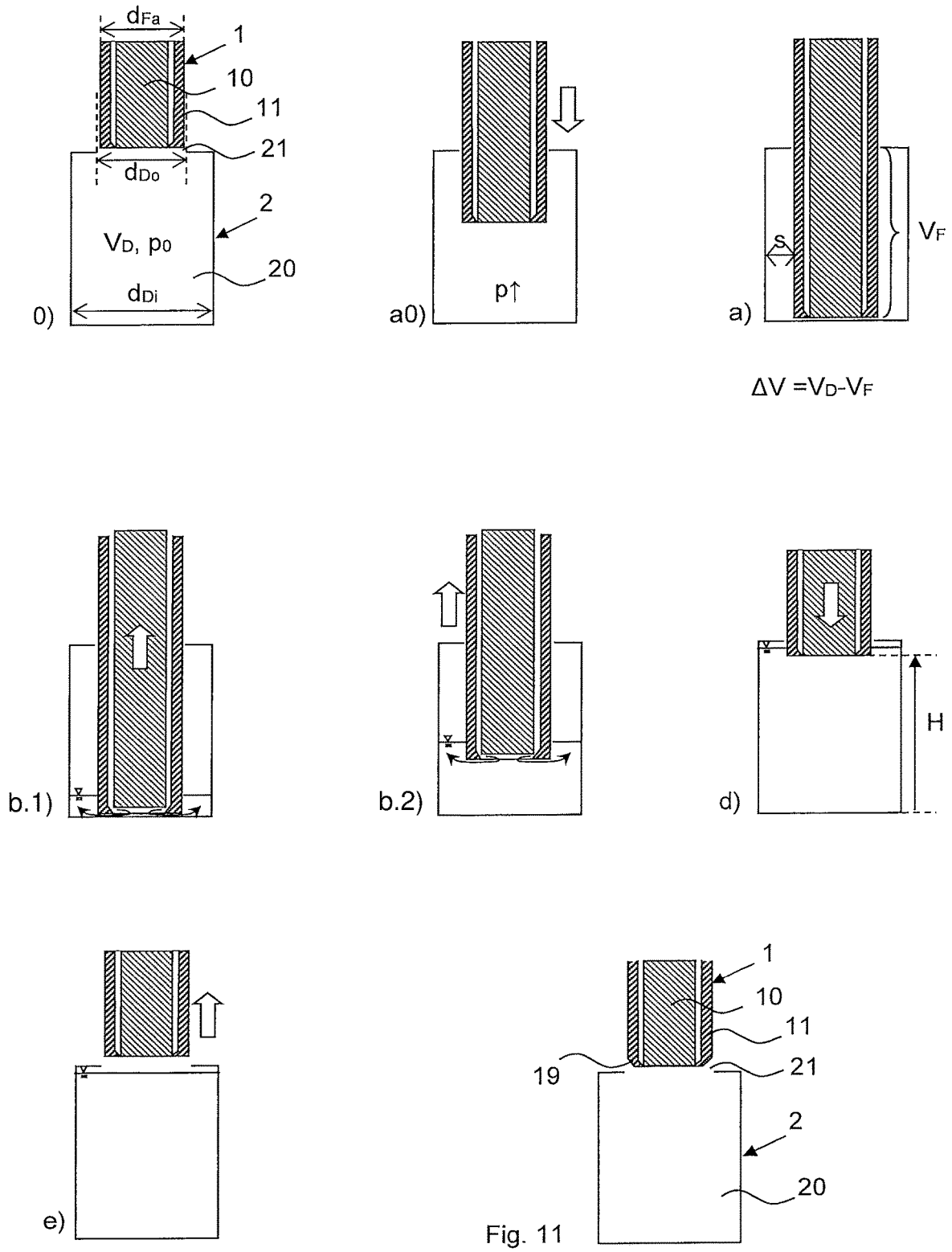
FIG. 8 schematic sectioned side views of a filling arrangement corresponding to FIG. 1 according to the steps 0) to e) of an embodiment of the method according to the invention with the course of the filling level.
FIG. 11 schematic sectioned side views of a filling arrangement according to FIG. 1, as in FIG. 8, with a filling valve with a conically tapering centering section at the filling tip.

The movable filling valve 1 that is comprised in the simplest embodiment of filling tube 11 and controllably guided piston 10 comprises an outer diameter $d_{Fa}$ that is matched to the diameter $d_{Do}$ of the container opening 21 in such a way that the filling valve 1 can be inserted without contact and without friction but also, as much as possible, without play through the container opening 21 into the container 2. The method, that is also illustrated schematically simplified in FIG. 8, provides that the container 2 (in step 0) is arranged in relation to the filling valve 1 such that a coaxial centric insertion of the filling valve 1 through the container opening 21 into the container 2 is enabled—this can be realized by axial movement of the filling valve or of the container, for example, by means of a corresponding movable container receptacle (not illustrated). Prior to insertion, the container volume $V_D$ is filled with ambient air (optionally also another gas) at an initial pressure $p_0$ (e.g. ambient pressure).

In step a0) in FIG. 8, it is indicated by the block arrow that the filling valve 1 is inserted into the container 2 so that the pressure p in the container rises when the container opening 21 is sealed. However, also without sealing action, a (temporary) pressure increase may occur when the air can escape only slowly through the filling opening 21 about the filling valve 1.

Step a) in FIG. 1 and FIG. 8 shows the filling valve 1 that has been completely inserted into the container 2. The filling tip of the filling valve 1 with the volume $V_F$ which has penetrated into the container 2 causes in this context either a pressure increase in the remaining gap volume ΔV when the filling opening 21 is sealed or a displacement of a major portion of the gas volume out of the container so that the quantity of gas or air and thus oxygen that is present in the gap volume ΔV (difference between container volume $V_D$ and inserted filling valve volume $V_F$) is significantly reduced.

As can be seen moreover in FIG. 1, the container 2 has a shaped bottom 22. So that the filling valve 1 can be completely inserted without deforming the bottom 22, the filling tube 11 at the end face end that comprises the sealing seat 13 for the piston 10 is shaped in accordance with the shape of the bottom 22.

In method step b), the valve 1 is moved by transfer of the piston 10 into an open position so that fluid can flow into the container 2 while at the same time the open filling valve 1 is moved upwardly. In FIG. 8, the step b) is shown in two illustrations b.1) and b.2) wherein in the illustration b.1), by means of the block arrow, the opening action of the filling valve 1 is illustrated that is lifted only slightly away from the container bottom—or comprises channels in the end face—so that fluid can flow into the gap volume ΔV. In the second illustration b.2) of step b), the block arrow indicates the upward movement of the open filling valve 1 wherein the rate of upward movement is matched to the inflow rate of the fluid so that the end face of the valve 1 with the valve opening is always below the liquid level in the gap volume ΔV.

It is apparent that the contact surface of the fluid in the gap volume ΔV is only a circular ring with ring width s (difference of half the container interior diameter $d_{Di}$ and of half the filling valve outer diameter $d_{Fa}$). Due to this filling below fluid level in which the fluid level in the gap volume ΔV is above the end face of the filling valve 1, the fluid contacts only at the circular ring-shaped contact surface the gas which is present in the container 2. The circular ring of the ring width s constitutes an extremely small contact surface so that the absorption of gas (in particular air oxygen) into the fluid is very minimal. The filling process below liquid level is continued by the upward movement of the filling tube 11 with the piston 10 in open position whereby hardly any turbulences are produced and the gas introduction through the contact surface is further reduced in this way. The reduced contact surface, together with the reduced air volume and the filling process below liquid level, leads to a significant reduction of oxygen absorption in the fluid.

Step c), illustrated in FIG. 1, shows the open filling valve 1 at a level of the container opening 21 up to which the upward movement of the filling valve 1 within the container 2 is coordinated in regard to the filling process or the filling quantity or the filling rate. For this purpose, a predefined control parameter is employed that takes into consideration the predefined filling volume in the container 2. Since cans are very exactly manufactured in regard to their volume, the predefined filling volume corresponds to the nominal volume. In the method illustrated in FIGS. 1 and 8, the control parameter in step c) can be a predefined filling time which is derived from a predefined filling volume in the container 2 and an adjusted filling volume flow of the filling device. Advantageously, no complex sensor means are thus required in this context.

After the predefined filling time, during which the upward movement of the open filling valve 1 with the inflow process below liquid level takes place, or upon reaching the predefined height H in the region of the container opening 21, closing of the filling valve 1 in a step d) takes place, as is indicated by the block arrow in the corresponding illustration in FIG. 8, wherein the predefined filling volume in the container 2 has been reached. Finally, in step e) the closed filling valve 1 is retracted so that the next container 2 can be subjected to the filling process.

FIG. 11 shows a filling valve 1 with a conically tapering centering section 19 at the filling tip by which the coaxial centered introduction of the filling valve 1 through the container opening 21 into the container 2 is assisted.

Figure 2:
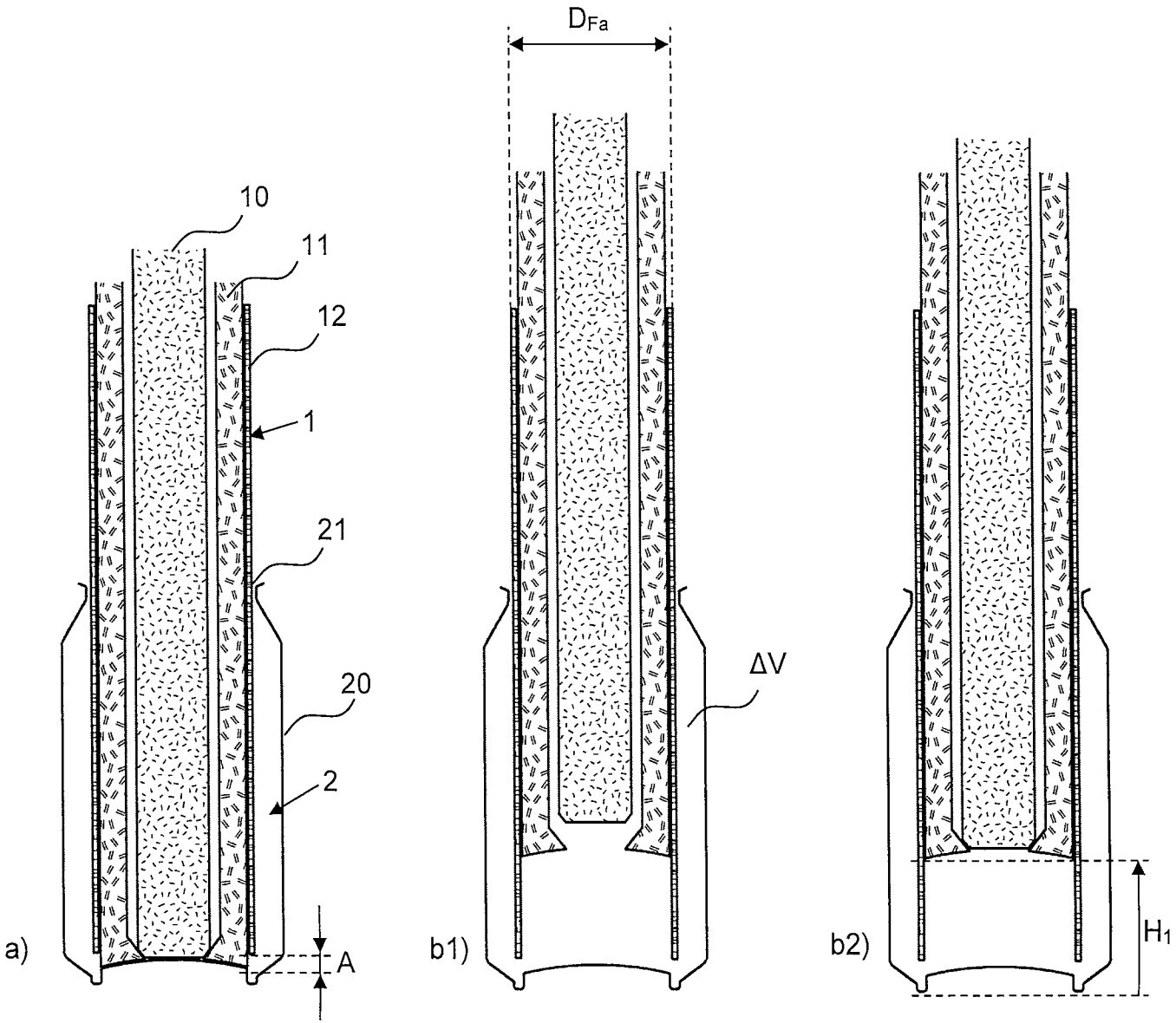
FIG. 2 sectioned side views of an alternative filling arrangement with a filling device that in addition comprises a separation tube, according to the steps a), b1), and b2) of an alternative embodiment of the method according to the invention.

FIGS. 2 to 5 and FIGS. 9, 10 show method steps with a preferred filling arrangement in which the filling valve 1 in addition comprises a separation tube 12 that is directly and coaxially arranged about the filling tube 11 and can be controllably moved independent thereof. FIG. 2 shows the filling arrangement without seal, and in FIG. 5 with seal. The respectively illustrated method steps are however applicable to both variants.

Figure 9:
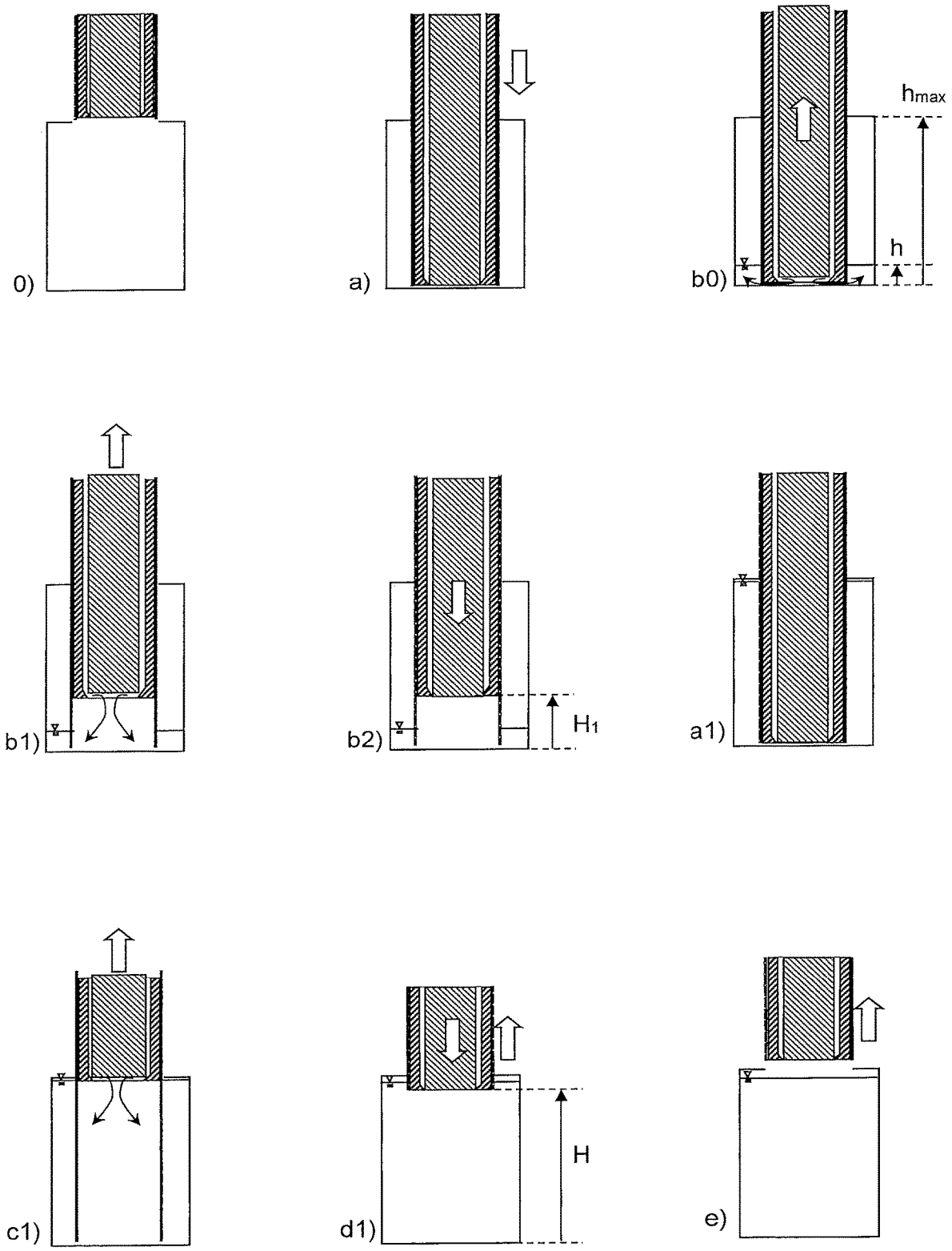
FIG. 9 schematic sectioned side views of a filling arrangement according to FIG. 2 and FIG. 5 according to the steps 0) to e) of an alternative embodiment of the method according to the invention with the course of the filling level.

Identified method steps which corresponds to the method disclosed in FIGS. 1 and 9 will optionally not be described again. The method that is performed with the filling device with separation tube 12 is also characterized by the reduced contact surface, a reduced air volume, and the filling process below liquid level which lead to a significantly reduced oxygen absorption in the fluid.

Accordingly, here also the filling valve 1 is completely inserted in step a) through the container opening 21 into the container 2. However, between the lower end of the separation tube 12 and the container bottom 22 an axial gap A remains in this context in order to allow fluid to flow into the gap volume ΔV that is formed between the container wall 20 and the separation tube 12 when, as shown in FIG. 9 in step b0) by means of the block arrow in the piston, the piston 10 has been transferred into an open position of the filling valve 1.

The filling method that utilizes a filling valve 1 with separation tube 12, as shown in FIG. 2, can be performed without sealing the container opening 21 so that gas or air can escape.

However, in particular in the variant with the separation tube 12 a counter pressure filling process can be performed also in which the container opening 21 is sealed about the filling valve 1, as illustrated in FIGS. 3, 4, 5, and 10.

In step b0), the piston 10 is transferred into an open position of the filling valve 1 and the fluid is allowed to flow through the axial gap A into the radial gap volume ΔV between the container wall 20 and the separation tube 12. The fluid flows into the radial gap volume ΔV until a pressure compensation between the filling pressure pre-adjusted in the filling device and the container pressure p exists, whereby the filling level h in the radial gap volume ΔV is determined. The container pressure p can be predefined and depends on whether the container opening is sealed or not and whether a check valve or overflow valve is present.

Thus, the fluid level does not rise any farther in the gap volume ΔV in the container 2 with open filling valve 1 when a pressure compensation between pressure in the container 2 and filling pressure is reached.

In order to now fill the gap volume completely up to the filling level $h_{max}$, preferably a pumping step is performed (as needed, also several of the pumping steps described in the following can be performed).

Upon the now following upward movement of the filling tube 11 with the piston 10 in open position within the separation tube 12, as indicated in step b1) by the block arrow above the piston, the separation tube 12 remains in its completely inserted position so that the separation tube 12 fills with fluid.

In FIG. 2 and FIG. 9, it is moreover illustrated that in step b2) the upward movement of the filling tube 11 with the piston 10 in the open position is terminated at a predefined height $H_1$ and the piston 10 is transferred into closed position. This height $H_1$ is predefined as a function of the filling level h in the radial gap volume ΔV which is achieved by the pre-adjusted filling pressure and the predefined container pressure p in step b0): The height $H_1$ can be calculated based on the volume which is limited in the separation tube 12 by the filling tube 11 at the height $H_1$ and that is to correspond to the volume difference of the gap volume ΔV between the maximum filling level $h_{max}$ and the achievable filling level h.

The fluid volume that is existing after step b2) up to the predefined height $H_1$ in the separation tube 12 is pushed in step a1) (FIGS. 5 and 9), by complete insertion of the filling tube 11 with the piston 10 in closed position, out of the separation tube 12 through the axial gap A into the radial gap volume ΔV. The fluid level therein rises correspondingly—preferably up to the maximum filling level, wherein the residual gas that is present is completely displaced out of the container. When the complete filling of the gap volume ΔV cannot be achieved with one pumping step, optionally the step sequence b0)-b1)-b2)-a1)-b0) . . . must be repeated until in a step a1) the gap volume ΔV is filled completely up to a region of the container opening 21.

In the step c1) illustrated in FIG. 9, the filling tube 11 with the piston in open position is then moved upwardly within the separation tube 12 up to a region of the container opening 21, and the entire separation tube volume fills with fluid. The upward movement(s) of the filling valve 1 within the container 2 up to the container opening 21 is realized here also by time control because all volumes (filling volume, gap volume, volume difference, volume in the separation tube etc.) are predefined or can be predefined. After c1), the piston 10 is transferred into closed position and the separation tube 12 is retracted in step d1), when the filling tube 11 has reached the predefined height H in the region of the container opening 21, wherein the fluid column existing previously in the separation tube 12 up to the valve remains in the container 2 which is thus completely filled, so that the filling valve 1 is retracted in step e).

Figure 4:
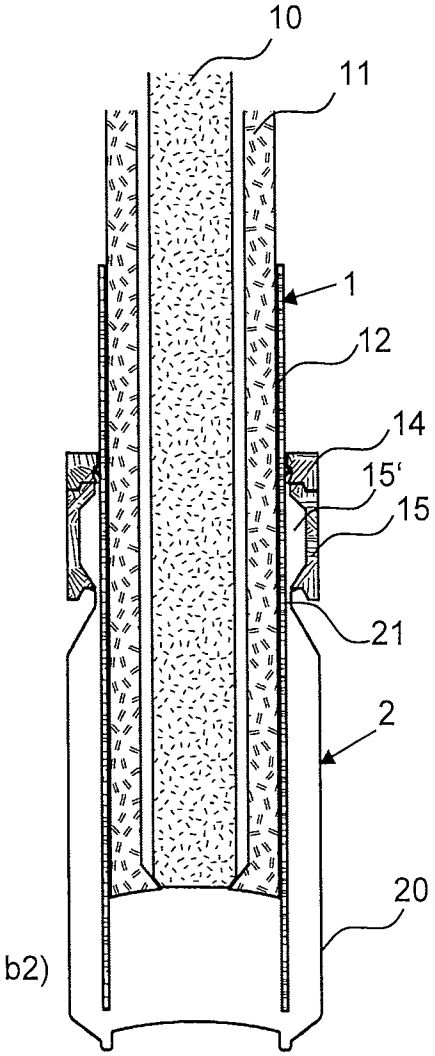
FIG. 4 a sectioned side view of a further embodiment of the filling arrangement of FIG. 2 in which a volume compensation attachment between sealing element and filling opening is arranged during a step b2) of an alternative embodiment of the method according to the invention.
Figure 3:
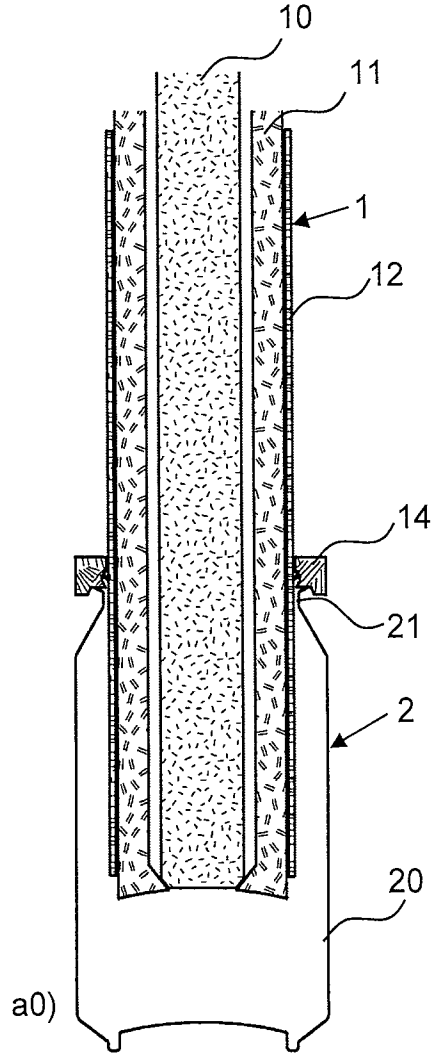
FIG. 3 a sectioned side view of a further embodiment of the filling arrangement of FIG. 2 in which the filling opening at the filling valve is sealed during a step a0) of an alternative embodiment of the method according to the invention.
Figure 5:
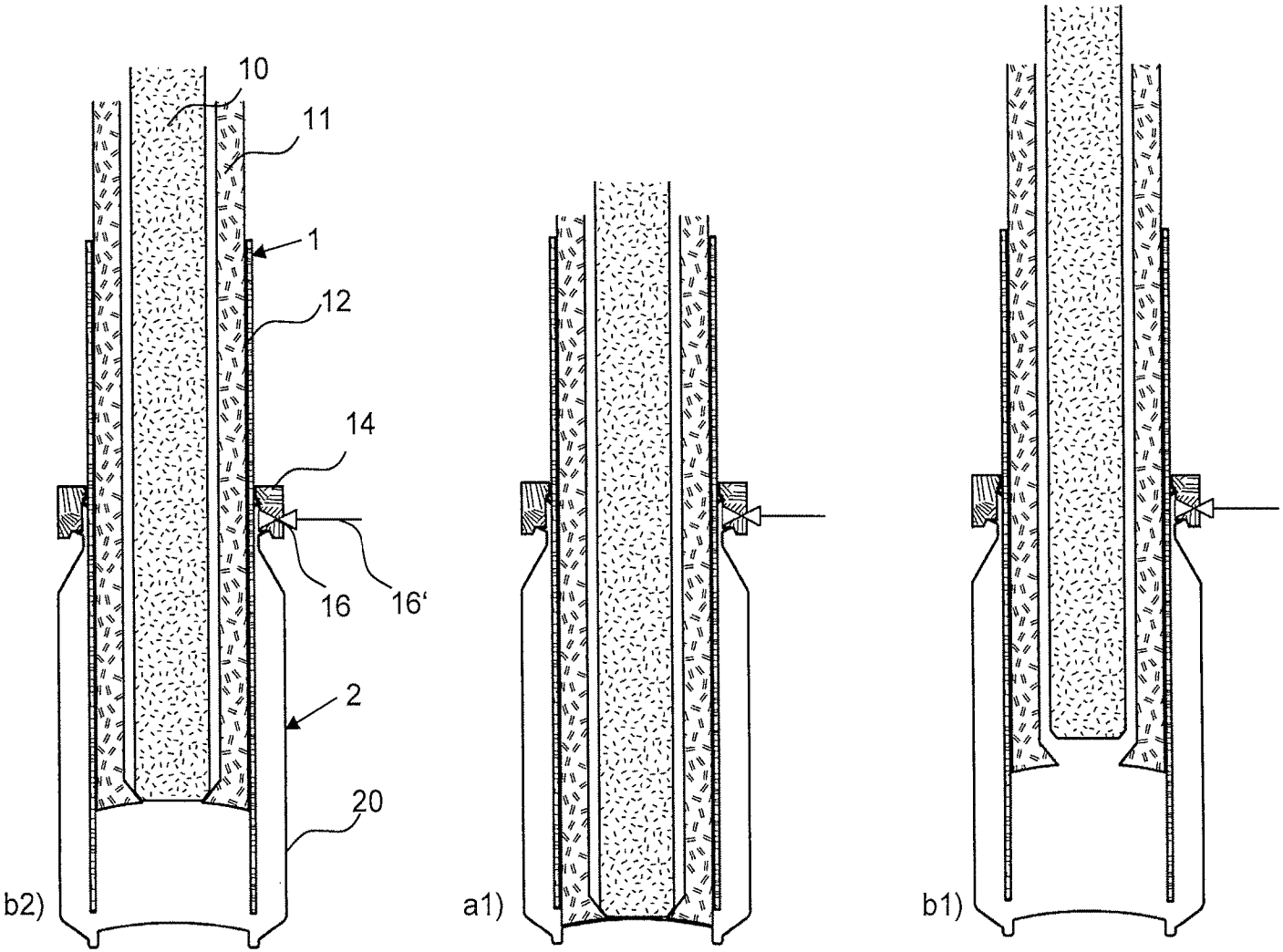
FIG. 5 sectioned side views of the filling arrangement of FIG. 3 in accordance with the steps b2), a1), and b1) as a continuation of the embodiment of the method according to the invention according to FIG. 2.

For performing a counter pressure filling process with post pressurization enabled by the separation tube 12, the container 2 is sealed at the filling valve 1, as illustrated in FIG. 3 or 4. FIG. 3 shows a method step a0) during insertion of the filling valve 1 into the container 2 at a point in time at which the seal 14 is attached. By means of the point in time of attaching the seal 14 or the penetration depth of the filling valve 1 into the container 2 at this point in time, the pressure p is determined which is present in the sealed container 2 when the filling valve 1 according to step a) is completely inserted.

As a function of the desired pressure p, the seal 14 can also be placed onto the container 2 prior to insertion of the filling valve 1, wherein a maximum pressure is achieved, based on the container volume $V_D$ and the volume $V_F$ of the completely inserted section of the filling valve 1, after the complete insertion of the filling valve 1 through compression of the gas quantity present in the container volume $V_D$. For counter pressure filling, in order to prevent foaming of carbon dioxide-containing fluids during filling, a pressurization pressure of 3 bar can be adjusted in the container 2, for example, when a filling pressure of 2 bar is provided.

Figure 10:
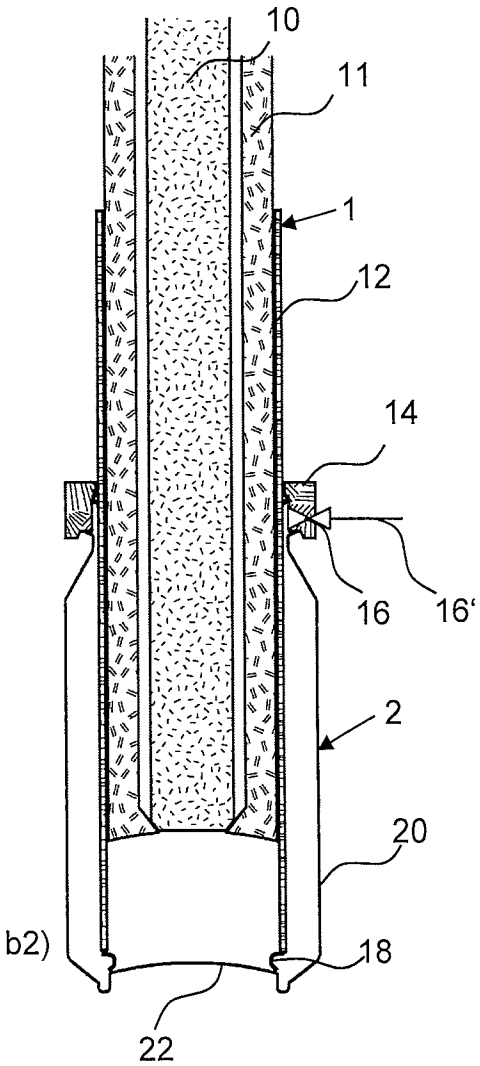
FIG. 10 a sectioned side view of a further embodiment of the filling arrangement with a valve in the sealing element and a unilaterally acting annular seal at the end face of the filling valve in order to avoid return flow out of the annular gap during counter pressure filling.

In particular in such a case it is particularly advantageous when, as indicated in FIG. 10, at the end face of the separation tube 12 in the axial gap A a circumferentially extending unilaterally acting annular seal 18 such as, for example, a sealing lip is employed that prevents that fluid or gas can flow out of the gap volume ΔV back into the separation tube 12. Escape of fluid through the axial gap A is permitted and can in particular be realized through one or several of the afore described pumping steps.

FIG. 4 shows the additional arrangement of a volume compensation attachment 15 which is employed between the container opening 21 and the sealing element 14 in a sealing fashion when sealing the container opening 21 about the filling valve 1. The volume compensation attachment 15 is used preferably in an embodiment of the method that comprises in addition an elastically expandable body and that will be explained later on in connection with FIG. 7 in more detail.

In order not to surpass a predefined highest pressure for the respective filling process in the container 2, a pressure relief valve 16 can be arranged in the sealing element 14 (see FIGS. 5 and 6) or in the volume compensation attachment 15 (see FIG. 7) and, as illustrated, can open, but must not open, into a gas discharge line 16'.

With the pressure relief valve 16 upon "post pressurization" in step a1), wherein the fluid volume that is present after step b2) up to the predefined height $H_1$ in the separation tube 12 is pushed by complete insertion of the filling tube 11 with the piston 10 in closed position out of the separation tube 12 through the axial gap A into the radial gap volume ΔV, it is prevented that the pressure p in the container 2 surpasses the predefined highest pressure. In addition, by keeping constant the pressure in the container 2, an increased gas introduction is avoided which otherwise would take place with increasing pressure.

Figure 6:
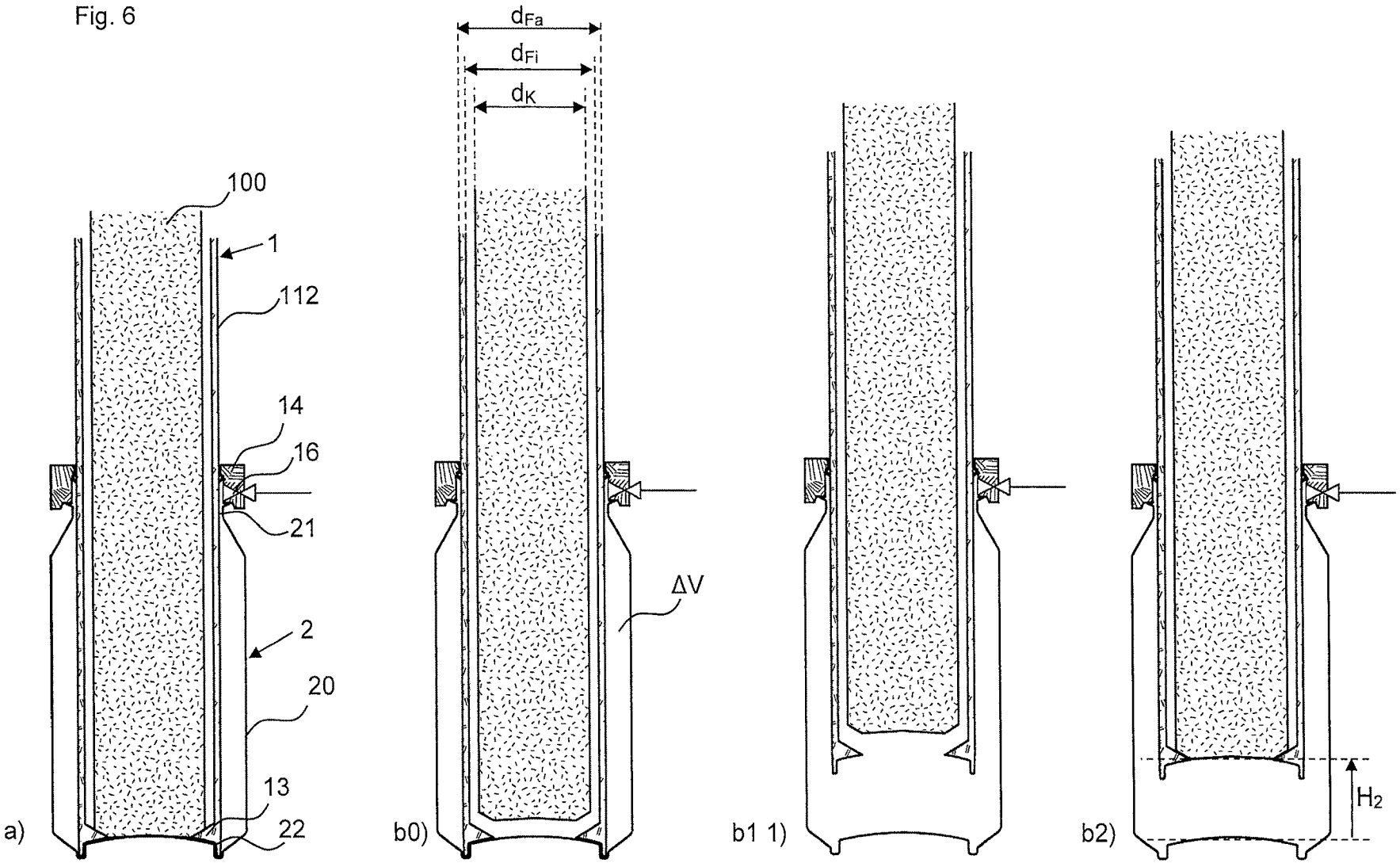
FIG. 6 sectioned side views of a further filling arrangement according to the invention with a filling valve of the thin-walled combined separation/filling tube and a wider piston with greater stroke travel and two opened positions according to the steps a) to d1) of an alternative embodiment of the method according to the invention.

FIG. 6 shows in eight illustrations an embodiment of the method that employs an alternative filling valve 1 with a combined separation/filling tube 112. The difference to the filling valve 1 of FIG. 1 resides in that the separation/filling tube 112 with identical outer diameter $d_{Fa}$, which is embodied to match the diameter $d_{Do}$ of the container opening 21, has a greater inner diameter $d_{Fi}$ and therefore has a significantly thinner wall than the filling tube 11 of FIG. 1. Therefore, the corresponding controllably guided piston 100 has a corresponding greater diameter $d_K$ which is matched to the inner diameter $d_{Fi}$ of the separation/filling tube 112. A further difference to the filling valve 1 of FIG. 1 resides in a significantly enlarged stroke travel of the piston 100 in the separation/filling tube 112: In addition to the (first) open position in which the piston 100, like the one in FIG. 1, is arranged proximal to, i.e., near a sealing seat 13 of the separation/filling tube 112, the thick piston 100 in the separation/filling tube 112 can be moved into a second open position in which the piston 100 is arranged distal to, i.e., remote, relative to the sealing seat 13 of the separation/filling tube 112. In this second open position, the piston 100 delimits a displacement volume $V_V$ within the separation/filling tube 112 that provides together with the gap volume ΔV the predefined filling volume of the container 2.

In the method variant illustrated in FIG. 6, in step a) the filling valve 1 is completely inserted into the container 2 until the end face of the filling valve 1 contacts the container bottom 22. The illustrated variant shows counter pressure filling wherein the container opening 21 is sealed about the filling valve 1. The adjustment of the pressure is realized as described above. The method can be performed however also without sealing action.

The counter pressure filling method performable with this filling arrangement with the separation/filling tube 112 combines the method steps of the above-described method wherein in step b0) the filling valve 1 is opened in that the piston 100 is moved into the first open position of the filling valve 1 so that fluid can flow into the radial gap volume ΔV between the container wall 20 and the separation/filling tube 112. Subsequently, an upward movement of the separation/filling tube 112 with the piston 100 in open position is performed in the step b1.1), wherein here also a filling process below fluid level is achieved in that the fluid level (not illustrated) in the gap volume ΔV during the filling process during the upward movement is located above the end face of the filling valve 1. The additional advantages of the above examples are also realized with this embodiment.

Thus, in step b2) at a predefined height $H_1$ the upward movement of the separation/filling tube 112 with the piston 100 in the first open position is stopped and the piston 100 transferred into the closed position. Even without separate separation tube 12, by renewed complete insertion of the separation/filling tube 112 with the piston 100 in closed position in the step a1), a post pressurization or pumping step can be performed with which the level of the fluid level in the gap volume ΔV can be raised, wherein the pressure in the container 2 due to the pressure relief valve 16 remains constant. Then, step b0) is repeated—whether steps b1.1), b2), and a1) are repeated depends on the geometric conditions and the predefined height $H_1$—before in step c1) the separation/filling tube 112 is transferred into a position in which an axial gap A, as for the separation tube 12, remains between the lower end of the separation/filling tube 112 and the container bottom 22 before the piston 100 is moved into its second open position and the separation/filling tube 112 is filled with fluid. The position of the piston 100 in the second open position is selected such that the displacement volume $V_V$ within the separation/filling tube 112 supplements the gap volume ΔV to the predefined filling volume so that in step d1) the separation/filling tube 112 is retracted to the predefined height H in the region of the container opening 21 until the piston 100 reaches the closed position so that the fluid passes from the separation/filling tube 112 into the container 2 and the latter is completely filled. The step e), not illustrated, follows in which the filling valve 1 is retracted. This method also uses the known geometric parameters and can be performed with time control with a coordinated movement sequence.

Figure 7:
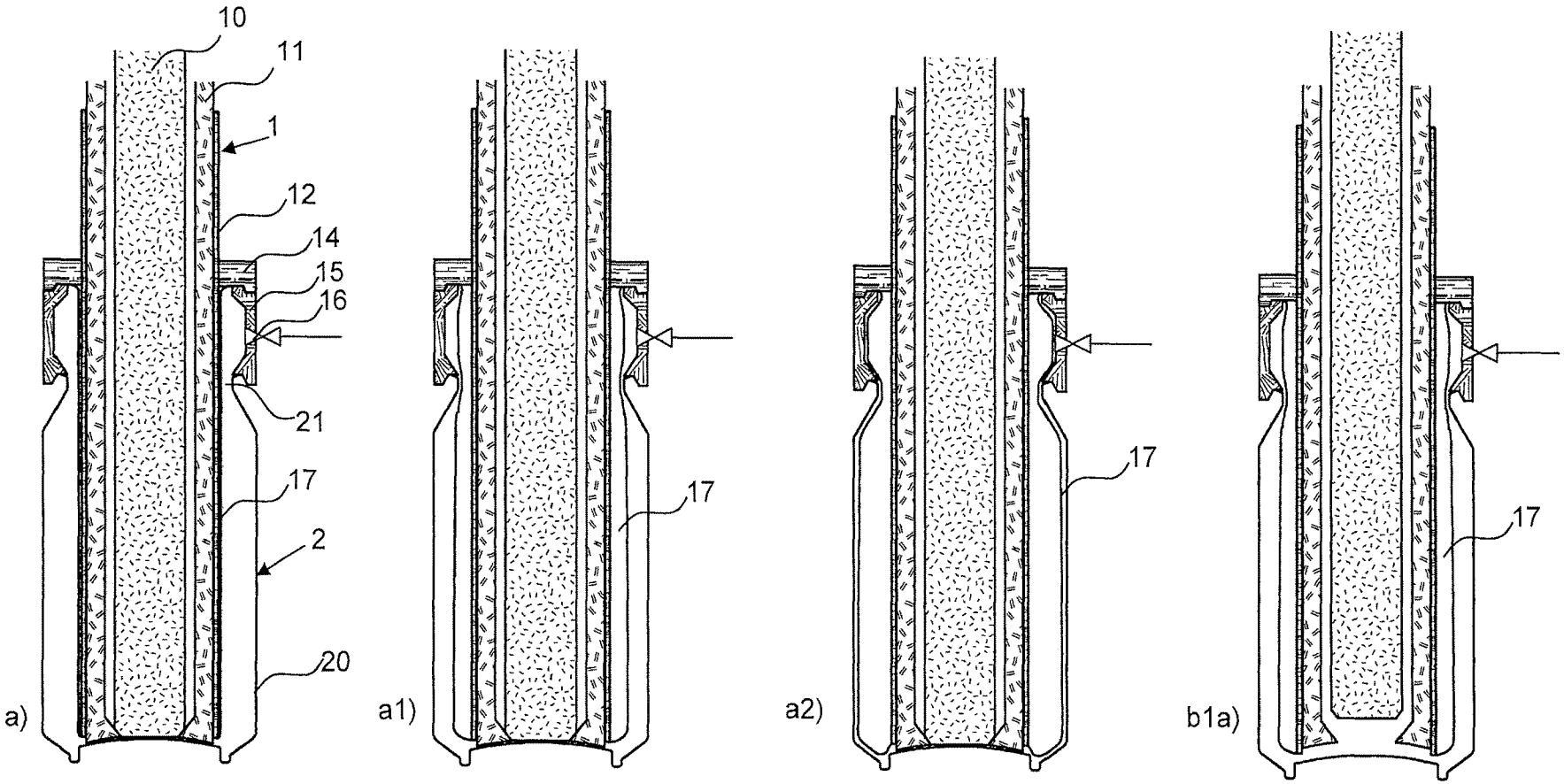
FIG. 7 sectioned side views of a further filling arrangement according to the invention in accordance with FIG. 4, in addition with an elastically expandable body surrounding the separation tube, according to the steps a) to d1) and d2) of a further alternative embodiment of the method according to the invention.

A further advantageous embodiment of the method according to the invention with a filling arrangement that is also in accordance with the invention is illustrated in FIG. 7. Here, a filling valve 1 with separation tube 12 is used which is surrounded by an elastically expandable body 17 which extends along the entire section of the separation tube 12 inserted into the container 2 (including volume compensation attachment 15 in this embodiment). Of course, here also deviating arrangements are conceivable. For example, also several elastically expandable bodies can be arranged circumferentially and/or axially distributed about and at the filling valve 1. Also, an arrangement of an elastically expandable body at one of the described filling valves without separation tube 1 is conceivable. And in a variant without volume compensation attachment 15, the elastically expandable body extends accordingly only along the entire section of the separation tube 12 inserted into the container 2. Type, number, and arrangement of the elastic expandable body or bodies depends on the latter being allowed to expand in step a1), after in step a) the closed filling valve 1 has been inserted completely into the container 2 which is sealed thereby, so that in step a2) it contacts the inner surfaces of the container 2 and, as in the illustrated example, the inner surface of the volume compensation attachment 15 and, at the same time, almost completely forces the ambient air (or another gas) present before in the container 2 through the pressure relief valve 16 present in the volume compensation attachment 15. The expansion of the elastically expandable body 17 can be effected by supply of an expansion fluid which can be a gas, but it is also conceivable that, after complete insertion of the filling valve 1 whereby gas has been displaced from the container, the filling tube 11 with the piston 10 in closed position is moved upwardly so that in the container 2 a vacuum is produced which causes expansion of the elastically expandable body 17. The latter is however possible only in containers that are sufficiently stable relative to external pressure; usually, beverage cans have a high strength regarding internal pressure but the external pressure resistance of unfilled cans is not very high—empty cans can be relatively easily crushed. Therefore, the expansion by supply of an expansion fluid may be preferred.

In the next b-steps, first the transfer of the piston 10 into the open position of the filling valve 1 is carried out so that fluid flows into the radial gap volume ΔV between the container wall 20 and the filling valve 1 whereby the elastically expandable body 17 in step b1 a) is compressed until it is contacting again the separation tube 12 (step bib). When the gap volume ΔV and the annular gap between the volume compensation attachment 15 and the filling valve 1 is filled, an upward movement of the filling tube 11 with the piston 10 in open position up to a predefined height H in a region of the container opening 21 is performed in the step b2) (not illustrated), wherein the separation tube 12 remains in the completely inserted position with the axial gap A so that the separation tube 12 is filled with fluid. The filling valve 1 in step d1) is closed when in step b2) the predefined height H in the region of the container opening 21 is reached. In step d2) the retraction of the separation tube 12 follows which here advantageously opens at the same time the seal 14 which is connected to the separation tube 12. Subsequently, the closed filling valve 1 in step e), not illustrated, is retracted from the completely filled container 2.

The volume compensation attachment 15, which is also shown in FIG. 4, provides together with the annular gap 15', which is formed between the inner wall of the volume compensation attachment 15 and the separation tube 12, a volume which corresponds to a displaced volume that is caused by the portion of the filling valve 1 that upon closing of the filling valve 1 in step d1) is located within the container 2, which in this case is the separation tube 12. In this way, the fluid, which has flowed upon filling of the container 2, initially the gap volume ΔV, in the steps b) and c) up to the annular gap 15' of the volume compensation attachment 15, can flow into the container 2 when opening the seal 14 by retraction of the separation tube 12 in step d2) so that the predefined filling volume is present in the container 2.

Figure 12:
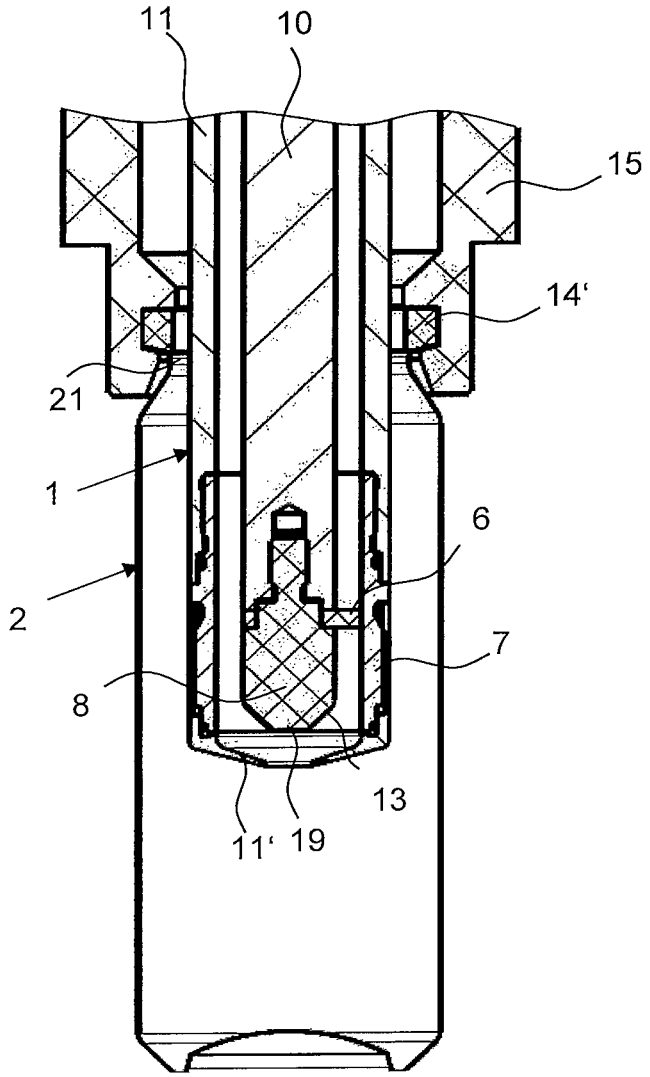
FIG. 12 a sectioned side view of a further embodiment of the filling arrangement with a filling valve with exchangeable filling tip and concentric spacer.

The filling arrangement in accordance with the invention according to a further embodiment, which is illustrated in an exemplary fashion in FIG. 12, shows a volume compensation attachment 15 wherein here also a sealing element 14' is illustrated with which the volume compensation attachment 15 is sealed at the container opening 21 of the container 2. The above described embodiments with volume compensation attachment 15 can also be sealed with a suitable sealing element at the container opening 21.

Moreover, the filling valve 1 illustrated in FIG. 12 comprises a filling tube 11 and a piston 10 which are furnished each with an exchangeable filling tip section 7, 8. These filling tip sections 7, 8 can be connected by any screwing, locking or plug-in mechanism, for example, also by a bayonet closure. With the exchangeable filling tips 7, 8, the filling valve 1 can be simply and quickly matched, for example, to containers with different bottom geometries. Moreover, by different filling tip sections, the outflow behavior of the fluid can be affected. Finally, the elimination of leaks by simple exchange of the filling tip sections can also be performed significantly more quickly.

The centering section 19 which is present at the filling tip 8 of the piston 10 and tapers toward the end face can ensure an improved sealing action when the valve is closed because the sealing seats 11', 13 will always come to rest on each other with proper fit in this way.

In order to enhance the centered guiding action of the piston 10 in the filling tube 11, the filling valve 1 has a radial spacer device 6 which in the illustrated example is comprised of a ring attached to the piston and from which spacer sections are radially projecting. Due to the section illustration, in FIG. 12 only one of these spacer sections can be seen which are arranged symmetrically about the center axis defined by the piston 10. The spacer sections of the spacer device 6 are in this context embodied such that they can glide along the inner side of the filling tube 11 when the piston 10 is moved up and down for opening and closing the valve 1. Preferably, a spacer device 6 can comprise three radial spacer sections which are symmetrically arranged at an angle of 120° relative to each other because in this way the centering action is ensured and in this way the flow cross section in the filling tube 11 is only minimally reduced. However, more than three radial spacer sections that are symmetrically arranged relative to each other can be provided. Different than illustrated, a radial spacer device can also be arranged at the inner side of the filling tube wherein the spacer sections are contacting glidingly the piston 10.

It is noted that, different than illustrated, also filling valves according to the invention without exchangeable filling tip sections can be provided with centering section and/or spacer device. For example, the elements described in connection with FIG. 10, centering section 19, exchangeable filling tip sections 7, 8, and radial spacer device 6, must not mandatorily be realized in the illustrated combination but can also be individually present at filling arrangement or filling valve according to the invention. For example, a filling valve can have an exchangeable tip without the latter comprising a tapering centering section or radial spacer and without the filling arrangement comprising a sealed volume compensation attachment, etc. Also, these elements are not limited to a simple filling valve but can also be present at filling arrangements with separation tube, combined separation/filling tube, and with expandable body. The same applies also to the embodiments of the filling valve with flow guiding structure described in the following.

In order to further improve the filling process and to achieve essentially laminar flow conditions so that the fluid level in the gap volume rises calmly and enclosed gas bubbles are avoided, a further embodiment of the invention provides that the filling valve 1 comprises a flow guiding structure 9 that imparts to the outflowing fluid a defined swirling or vortex movement. In this way, it is avoided that the fluid, which is exiting at filling pressure, impacts radially against the container wall and rebounds causing more gas bubbles to be enclosed which would accumulate to the end of the filling process and then cause a strong foaming action.

Figure 13:
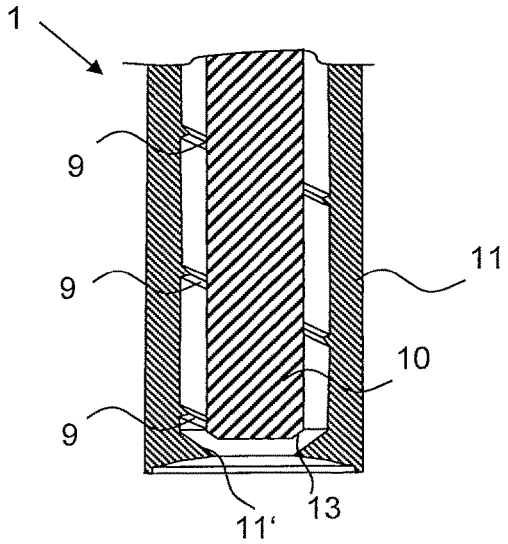
FIG. 13 a schematic longitudinal section view of a filling valve according to the invention with a coil web-type flow guiding structure in the filling tube.
Figure 14:
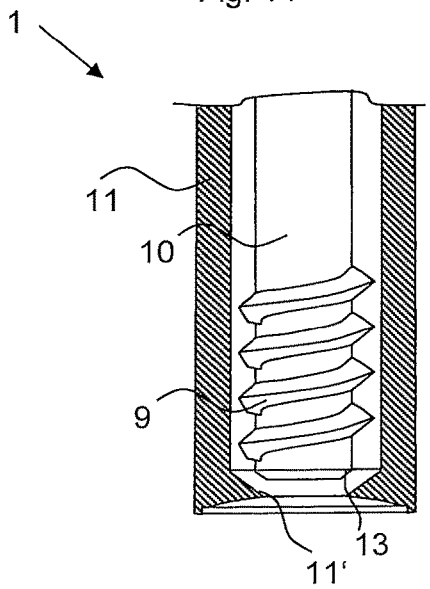
FIG. 14 a schematic longitudinal section view of a filling valve according to the invention with a coil web-type flow guiding structure at the piston.
Figure 15:
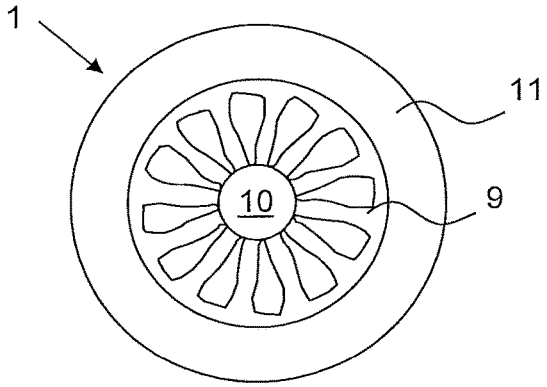
FIG. 15 a schematic cross-section view of a filling valve according to the invention with a flow guiding structure of guide vanes at the piston.
Figure 16:
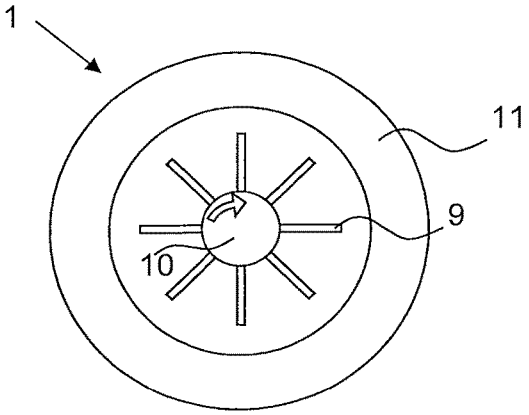
FIG. 16 a schematic cross-sectional view of a filling valve according to the invention with a flow guiding structure of moving vanes at the rotating piston.

The flow guiding structure, as shown in FIG. 13, can be present at an inner side of the filling tube 11 or, as shown in the examples of FIGS. 14 to 16, at an outer side of the piston 10 above the respective sealing surfaces 11', 13. Different than illustrated, flow guiding structures interacting with each other can be provided at both filling tube and piston, while the filling valve can also be a filling valve that opens outwardly or downwardly.

The examples in FIGS. 13 and 14 show each in the filling tube 11 and at the piston 10 a flow guiding structure 9 that is formed by a coil web similar to a thread. Also, several parallel extending coil webs can be provided.

FIGS. 15 and 16 show a vane structure as flow guiding structures at the outer side of the piston 10. Different than illustrated, a vane structure can also be provided at the inner side of the filling tube.

The flow guiding vane structure 9 at the piston 10 in FIG. 15 is formed by an annular arrangement of guide vanes that are curved at least in two planes in order to impart a swirling or vortex movement to the fluid flowing past them.

FIG. 16 shows an example in which the flow guiding vane structure 9 is formed by an annular arrangement of moving vanes that are uncurved here. In order to impart a swirling or vortex movement to the fluid passing them, the piston 10 is designed to be driven in rotation, as is indicated by the block arrow. When the moving vanes are curved, it is sufficient when the piston 10 is rotatably supported because the fluid flowing past the moving vanes will cause the piston 10 to rotate so that the swirling or vortex generation is assisted even without a drive.

Advantageously, a flow guiding structure can be at the same time embodied as a radial spacer device or the radial spacer sections can be designed as flow guiding structure, i.e., in a vane shape.

35 It is noted that in the illustrated examples the opening direction of the filling valve is always illustrated with a movement of the piston inwardly or upwardly wherein the sealing seat at the piston points downwardly and the sealing seat at the filling tube upwardly. However, aside from the variant with combined separation/filling tube, in accordance with the invention also embodiments of filling valves are to be expressly encompassed which open in opposite direction, i.e., in which the piston for opening is moved downwardly for which purpose the piston tip comprises usually a plate-shaped widened end section in order to provide an upwardly facing sealing seat which can contact a corresponding downwardly facing sealing seat of the filling tube.

It is apparent that, based on the basic principle of the invention, a plurality of different embodiments of the method are conceivable of which here only some have been explained in an exemplary fashion and which are not meant to limit the protection defined by the claims.

Any modification which utilizes the basic principles of the invention is to be encompassed: According to the invention, the filling quantity determination is realized by means of the known geometries (volume) of the container (can) and of the filling valve that at the same time represents a displacement element. Various embodiments are conceivable for the filling valve. A filling valve according to the invention (with or without separation tube, expansion body . . . ) is matched with its outer diameter to the diameter of the container to be filled which exhibits only a minimal difference to the container diameter. Accordingly, in comparison to the prior art, expensive measuring devices such as MID sensors can be eliminated. Also, the control action of filling based on filling level, adjusted by the position of the opening of a return air pipe or of a return air bore or by means of sensor, actor or suitable control logic, can be dispensed with.

With the geometric conditions of the filling arrangement—the size of the annular surface between container wall and filling valve is dependent on container diameter and container opening diameter and can therefore be also very small—the contact surface reduction is realized that leads to a reduced gas absorption into the filled-in fluid. While in the prior art the ambient air present in the container is purged by carbon dioxide which causes a very high carbon dioxide consumption, the oxygen quantity is significantly reduced according to the invention already by the mechanical displacement of the air out of the container due to the geometric conditions, even in embodiments without expandable body. Due to the filling process below fluid level about the separation or filling tube, reduced or no turbulence of filled-in fluid and residual gas in the container is produced so that the oxygen absorption is further minimized. In the variant with the pumping step or "post pressurization", with the transfer of the fluid into the gap volume further residual gas (and thus oxygen) is removed from the container through the pressure relief valve so that here also no oxygen absorption occurs. Moreover, a very quick filling process which in its realization is almost laminar can be obtained due to this "post pressurization".

Furthermore, the required pressure (counter pressure, saturation pressure, filling pressure) for counter pressure filling which in the prior art is generated by compressed gas, mostly carbon dioxide or nitrogen, can be provided mechanically by sealing the filling opening during insertion of the filling valve so that pressurization gas and corresponding devices for supply can be dispensed with. The desired pressure is adjustable in a simple way by determining the required insertion depth for given geometric conditions.

Also, a counter pressure filling without return air tube is enabled so that the separate control action, cleaning, and maintenance of the return air tubes or return air conduits is not needed while still required in the prior art: Here usually the one-chamber principle for filling is employed. The container to be filled and a storage container at the filling device (annular reservoir) form together a chamber during the actual filling process. The liquid that is flowing into the container to be filled displaces the gas contained therein into the storage container. There are also multi-chamber solutions which however up to now have not found acceptance because the individual chambers can be separated properly only when a filling material loss is accepted. A true separation of the chambers can be done only with a complex apparatus structure with a balloon element or impermeable membrane.

In summary, for filling containers such as cans, measuring means for monitoring the filling quantity as well as purging or pressurization gas can be dispensed with by means of the invention wherein the employed filling device is of a really simple construction and hardly prone to failure. Even though the invention preferably does not require purging and pressurization gas, performing such steps in the method according to the invention is not excluded.

In this invention, known parameters are used that prior to, during, and after the filling process do not change. It is decisive that these parameters cannot be changed or controlled. The ambient pressure, the can volume, and the displacement volume of the filling valve remain constant and cannot be controlled. These parameters are determined at a suitable time (measured or calculated) and are used at a different point in time for pressure and (filling) volume determination during the filling process. These parameters are moreover used such that during the filling process at a predefined point in time a nominal pressure and/or a nominal volume can be adjusted solely by a relative movement of the individual parts (filling valve, seal, separation tube . . . ) along an axis in relation to the container.

LIST OF REFERENCE CHARACTERS

1 filling valve
10 piston
11, 11' filling tube, sealing seat
12 separation tube
13 sealing seat/contact surface
14, 14' sealing element
15, 15' volume compensation attachment
16 valve
16' gas discharge conduit
17 elastically expandable body
18 unilaterally acting annular seal, sealing lip
19 centering section
100 wide piston
112 combined separation/filling tube
2 cylindrical container, can
20 container wall
21 container opening
22 container bottom
6 radial spacer
7 exchangeable filling tube filling tip section
8 exchangeable piston filling tip section
9 flow guiding structure
$d_{Fa}$ outer diameter filling device
$d_{Fi}$ inner diameter filling tube
$d_K$ piston diameter
$d_{Di}$ container interior diameter
$d_{Do}$ inner diameter container opening
A axial gap
H predefined height
h, $h_{max}$ filling level in gap volume, maximum
s gap width in gap volume
$V_D$ container volume
$V_V$ displacement volume
$V_F$ inserted filling valve volume
$\Delta V$ radial gap volume
$p_0$ ambient pressure
p container pressure

What is claimed is:

1. A method for filling a container having a predefined cylindrical form with a fluid by using a filling device for the container, wherein the container comprises a concentric container opening comprising a diameter ($d_{Do}$) which amounts to 70% to 99.5% of a container interior diameter ($d_{Di}$), wherein the filling device comprises a filling valve, the filling valve comprising a piston controllably guided in a filling tube and comprising an open position in which the filling valve is in an open state and a closed position in which the filling valve is in a closed state, wherein the filling valve is movable relative to the container and comprises an outer diameter ($d_{Fa}$) matching the diameter ($d_{Do}$) of the concentric container opening so that a filling tip of the filling valve is insertable and retractable coaxially into/from the container through the concentric container opening with little play but without contact and without friction, wherein the filling tip of the filling valve comprises a volume ($V_F$) occupying in the container a volume in a range of 49% to 99% of a container volume ($V_D$) of the container; the method comprising the steps of:

a) moving the filling valve, in the closed state, and the container relative to each other, wherein the filling tip of the filling valve is received through the concentric container opening in the container, and displacing a gas that is contained in the container in accordance with a volume ($V_F$) of the filling tip of the filling valve out of the container or compressing in the container the gas that is contained in the container;

a0) sealing the concentric container opening about the filling valve with a sealing element prior to step a) or during step a), wherein a point in time of sealing the concentric container opening determines a pressure (p) existing in the container after the filling valve has been completely inserted into an end position in the container;

b) performing a filling process by moving the piston into the open position and allowing flow of the fluid into the container so that an end face of the filling valve, facing a container bottom and comprising a valve opening, is located below a fluid level in a radial gap volume (ΔV) between a container wall of the container and the filling valve;

c) adjusting during the filling process a relative upward movement of the filling valve within the container up to the concentric container opening according to a predefined control parameter, wherein the predefined control parameter takes into consideration a predefined filling volume in the container, wherein the filling process is carried out below fluid level in that the fluid level in the radial gap volume (ΔV) during the relative upward movement is positioned above the end face of the filling valve during the filling process;

d) closing the filing valve by moving the piston into the closed position when the predefined filling volume in the container is reached; and e) removing the filling valve in the closed state from the container.

2. The method according to claim 1, wherein, in an end position of the filling valve, the filling valve:

is positioned at a predefined distance relative to the container bottom, or is positioned so that the end face of the filling valve contacts the container bottom directly or indirectly via a spacer.

3. The method according to claim 1, wherein the filling valve comprises a separation tube disposed about the filling tube, wherein the separation tube is controllably movable independent of the filling tube and of the piston; wherein:

step a) includes: (a moving the filling valve to a position in the container such that a lower end of the separation tube of the filling valve is in an axial position with an axial gap (A) remaining between the lower end of the separation tube and the container bottom;

step b) includes: (b0) allowing the fluid to flow through the axial gap (A) into the radial gap volume (ΔV) between the container wall and the separation tube of the filling valve until a pressure compensation between a pre-adjusted filling pressure and a predefined container pressure is present, wherein a filling level (h) in the radial gap volume is determined by the pressure compensation; (b1) performing a relative upward movement of the filling tube within the separation tube, while the separation tube remains in the axial position relative to the container bottom and the piston remains in the open position of the filling valve, and filling the separation tube with the fluid; and (b2) at a predefined height (H) terminating the relative upward movement of the filling tube;

step d) includes retracting the separation tube when the predefined height (H) is in a region of the concentric container opening and the container is completely filled.

4. The method according to claim 3, wherein an achievable filling level (h) achievable in the radial gap volume is smaller than a maximum filling level ($h_{max}$) predefined by the container in the radial gap volume; the method further comprising:

performing, after step (b2) and prior to step d), a relative downward movement of the filling tube, with the piston in the closed position, and forcing a fluid volume, present in the separation tube, through the axial gap (A) into the radial gap volume up to the predefined height (H);

wherein step c) includes moving upwardly the filling tube, with the piston in the open position of the filling valve, within the separation tube up to the predefined height (H) which is located in a region of the concentric container opening and filling the separation tube with fluid;

wherein step d) includes retracting the separation tube after step b2), wherein the fluid present in the separation tube remains in the container.

5. The method according to claim 4, comprising repeating the steps b0), b1), b2), and $a_1$) until in step $a_1$) the radial gap volume is filled completely up to the maximum filling level ($h_{max}$).

6. The method according to claim 3, wherein, for filling the radial gap volume in step a1) with a single downward movement, the method further comprises, prior to performing the filling process according to step b), the step of determining a first predefined height ($H_1$) as a function of the achievable filling level (h) in the radial gap volume that is achievable in step b0) with the pre-adjusted filling pressure and the predefined container pressure (p) so that a volume, which is limited in the separation tube (12) by the filling tube (11) at the first predefined height ($H_1$), corresponds to a volume difference of the radial gap volume (ΔV) between a maximum filling level ($h_{max}$) and the achievable filling level (h).

7. The method according to claim 3, wherein the filling valve comprises an elastically expandable body, wherein:

step a) includes completely inserting the filling valve together with the elastically expandable body through the concentric container opening into the container, expanding the elastically expandable body, and contacting an inner surface of the container with the elastically expandable body;

step b) includes compressing the elastically expandable body by the fluid flowing into the container until the elastically expandable body contacts the separation tube of the filling valve and the radial gap volume between the container wall and the separation tube of the filling valve is filled.

8. The method according to claim 1, wherein the predefined control parameter is selected from the group consisting of a pre-adjusted filling time derived from a predefined filling volume in the container and an adjusted filling volume flow of the filling device, wherein closing of the filling valve in step d) is realized after the predefined filling time has lapsed;

a predefined height (H) in a region of the concentric container opening (21) at which the upward movement of the filling valve or of the filling tube is terminated and the piston (10) is transferred into the closed position.

9. The method according to claim 1, wherein the step a0) includes arranging a volume compensation attachment, prior to the filling process of step b), between the concentric container opening and the sealing element, wherein a volume of an annular gap, formed between the volume compensation attachment and the filling valve, corresponds to a displaced volume that is caused by a portion of the filling valve present within the container when closing the filling valve in step d), wherein in the steps b) and c) a portion of the fluid flows into the annular gap and in step e) the portion of the fluid flows into the container so that the predefined filling volume is provided in the predefined container.

10. The method according to claim 9, wherein the filling valve comprises an elastically expandable body, wherein:

step a) includes completely inserting the filling valve together with the elastically expandable body through the concentric container opening into the container, expanding the elastically expandable body, and contacting an inner surface of the container and of the volume compensation attachment with the elastically expandable body;

step b) includes compressing the elastically expandable body by the fluid flowing into the container until the elastically expandable body contacts the filling valve and the radial gap volume between the container wall and the filling valve and an annular gap between the volume compensation attachment wall and the filling valve is filled, and upwardly moving the filling tube with the piston in the open position up to a predefined height (H) in a region of the concentric container opening.

11. The method according to claim 10, further comprising preventing the pressure in the container from surpassing a predefined highest pressure for the filling process by arranging a check valve or an overflow valve in the sealing element or in the volume compensation attachment.

12. The method according to claim 9, further comprising preventing the pressure in the container from surpassing a predefined highest pressure for the filling process by arranging a check valve or an overflow valve in the sealing element or in the volume compensation attachment.

13. The method according to claim 1, wherein the filling tube is a combined separation/filling tube and wherein the outer diameter ($d_{Fa}$) of the filing valve corresponds to an outer diameter of the combined separation/filling tube, wherein the combined separation/filling tube is thin-walled and comprises an inner diameter ($d_{Fi}$), wherein the combined separation/filling tube comprises a sealing seat for the piston, wherein the piston comprises an outer diameter ($d_K$) matched to the inner diameter ($d_{Fi}$) of the separation/filling tube, wherein the piston comprises a first open position, in which the piston is arranged proximal to the sealing seat, and comprises at least one second open position, in which the piston is arranged distal to the sealing seat, wherein the piston in the at least one second open position limits a displacement volume ($V_V$) within the combined separation/filling tube (112), wherein the displacement volume together with the radial gap volume ($\Delta V$) results in the predefined filling volume of the container; wherein:

step b) includes (b0) transferring the piston into the first open position and allowing flow of the fluid into a radial gap volume between the container wall and the separation/filling tube;

(b1.1) upwardly moving the separation/filling tube with the piston in the first open position and allowing the fluid to flow farther into the radial gap volume until in the radial gap volume a pre-definable filling level is reached that depends on the pre-adjusted filling pressure and a pre-definable container pressure (p); (b2) at a second predefined height ($H_2$), stopping the separation/filling tube and transferring the piston into the closed position, wherein the second predefined height ($H_2$) is determined, prior to the filling process, as a function of the filling level in the radial gap volume ($\Delta V$) achievable in (b1.1) so that a volume that is limited below the separation/filling tube at the second predefined height ($H_2$) corresponds to a volume difference of the radial gap volume ($\Delta V$) between the maximum filling level ($h_{max}$) and the filling level (h) achievable in (b1.1), subsequently, completely inserting the separation/filling tube with the piston in the closed position into the container, subsequently, transferring the piston into the first open position and allowing flow of the fluid into the radial gap volume between the container wall and the separation/filling tube;

wherein step c) includes transferring the separation/filling tube into a position in which an axial gap (A) between a lower end of the separation/filling tube and the container bottom remains, and transferring the piston into the at least one second open position, located in a region of the concentric container opening, and filling the separation/filling tube with the fluid, step d) includes retracting the separation/filling tube, when the at least one second open position is reached, until the piston is in the closed position and allowing the fluid to pass from the separation/filling tube into the container to completely fill the container.

14. The method according to claim 1, wherein the filling valve comprises an elastically expandable body, wherein:

step a) includes completely inserting the filling valve together with the elastically expandable body through the concentric container opening into the container, expanding the elastically expandable body, and contacting an inner surface of the container with the elastically expandable body;

step b) includes compressing the elastically expandable body by the fluid flowing into the container until the elastically expandable body contacts the filling valve and the radial gap volume between the container wall and the filling valve is filled, and upwardly moving the filling tube with the piston in the open position up to a predefined height (H) in a region of the concentric container opening.

15. The method according to claim 1, wherein in step a) the gas is displaced out of the container when the container opening about the filling valve is not sealed by the sealing element.

16. The method according to claim 1, wherein in step a) the gas is compressed in the container when the container opening about the filling valve is sealed by the sealing element.

17. A filling arrangement for performing the method according claim 1, wherein the filling arrangement comprises:

a container having a predefined cylindrical form and comprising a concentric container opening comprising a diameter ($d_{Do}$) that amounts to 70% to 99.5% of a container interior diameter ($d_{Di}$) of the container;

a filling device comprising a filling valve, the filling valve comprising a filling tube and a piston controllably guided in the filling tube;

a sealing element arranged about the filling valve at the concentric container opening;

the filling valve comprising an outer diameter ($d_{Fa}$) matching the diameter ($d_{Do}$) of the concentric container opening so that a filling tip of the filling valve is insertable and retractable coaxially into/from the container through the concentric container opening nearly without play but without contact and without friction;

wherein the filling device is configured to provide a relative movement between the filling valve and the container to coaxially insert the filling tip of the filling valve into the container through the concentric container opening;

wherein the filling tip of the filling valve comprises a volume ($V_F$) that occupies in the container a volume in a range of 49% to 99% of a container volume ($V_D$) of the container;

wherein the filling device comprises a control action without a return air tube.

18. The filling arrangement according to claim 17, wherein the control action is configured to control the filling arrangement as a function of a predefined filling time at which the upward movement of the filling tube is terminated and the piston is moved into the closed position.

19. The filling arrangement according to claim 17, wherein the control action is configured to control the filling arrangement as a function of a predefined height (H) at which the upward movement of the filling tube is terminated and the piston is moved into the closed position.

20. The filling arrangement according to claim 17, wherein the control action requires no measuring means.

21. The filling arrangement according to claim 17, wherein the filling valve comprises a separation tube arranged about the filling tube, wherein the separation tube is controllably movable independent of the filling tube and of the piston.

22. The filling arrangement according to claim 17, wherein the filling tube is a combined separation/filling tube comprising an outer diameter ($d_{Fa}$) matching the diameter ($d_{Do}$) of the concentric container opening, wherein the combined separation/filling tube comprises a sealing seat, wherein the combined separation/filling tube is thin-walled and comprises an inner diameter ($d_{Fi}$), and wherein the controllably guided piston is embodied as piston comprising a diameter ($d_K$) matched to the inner diameter ($d_{Fi}$) of the combined separation/filling tube, wherein the piston comprises a first open position in which the piston is arranged proximal to the sealing seat and further comprises at least one second open position in which the piston is arranged distal to the sealing seat.

23. The filling arrangement according to claim 17, further comprising a volume compensation attachment arranged about the filling valve between the sealing element and the concentric container opening.

24. The filling arrangement according to claim 23, wherein the sealing element or the volume compensation attachment comprises a valve.

25. The filling arrangement according to claim 24, wherein the valve is a check valve or an overflow valve.

26. The filling arrangement according to claim 17, wherein the filling valve comprises an end facing a container bottom of the container and provided with radial flow channels or spacers.

27. The filing arrangement according to claim 26, wherein the spacers are elastic or springy spacers or a unilaterally acting annular seal.

28. The filling arrangement according to claim 26, wherein the end of the filling valve is embodied by an end face of the filling tube or by an end face of a separation tube arranged about the filling tube.

29. The filling arrangement according to claim 26, wherein the filling tube is a combined separation/filling tube and wherein the end of the filling valve is embodied by an end face of the combined separation/filling tube.

30. The filling arrangement according to claim 17, wherein the filling valve comprises an elastically expandable body arranged along the filling tip at least at one section or about a section of the filling tube.

31. The filling arrangement according to claim 17, wherein the filling valve comprises a centering section arranged at the filling tip and tapering toward an end face of the filling valve facing a container bottom of the container.

32. The filling arrangement according to claim 17, wherein the filling tube and the piston each comprise an exchangeable filling tip section.

33. The filling arrangement according to claim 17, wherein the filling tube or the piston comprises at least one gliding radial spacer device configured to center the piston in the filling tube.

34. The filling arrangement according to claim 17, wherein the filling valve comprises a separation tube arranged about the filling tube and further comprises an elastically expandable body arranged along the filling tip at least at one section or about a section of the separation tube.

35. The filling arrangement according to claim 17, wherein the filling valve comprises a flow guiding structure arranged at an inner side of the filling tube; at an outer side of the piston; or at the inner side of the filling tube and at the outer side of the piston, wherein the flow guiding structure is disposed above sealing surfaces of the filling valve at an end of the filling valve facing a container bottom of the container.

36. The filling arrangement according to claim 35, wherein the flow guiding structure is formed by a coil web.

37. The filling arrangement according to claim 35, wherein the flow guiding structure is formed by an annular arrangement of guide vanes that are curved at least in one plane.

38. The filling arrangement according to claim 35, wherein the flow guiding structure is an annular arrangement of curved or uncurved moving vanes arranged at the rotatably arranged piston.

* * * * *